US008801151B2

(12) United States Patent
Shibata et al.

(10) Patent No.: US 8,801,151 B2
(45) Date of Patent: Aug. 12, 2014

(54) LIQUID EJECTION APPARATUS AND DRIVE METHOD FOR INKJET HEAD

(71) Applicants: Fujifilm Corporation, Tokyo (JP); Fuji Xerox Co., Ltd., Tokyo (JP)

(72) Inventors: Hiroshi Shibata, Kanagawa (JP); Akira Wakabayashi, Kanagawa (JP); Masaki Kataoka, Kanagawa (JP); Yoshihira Rai, Kanagawa (JP); Kousuke Yunoki, Kanagawa (JP)

(73) Assignees: FUJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/676,373

(22) Filed: Nov. 14, 2012

(65) Prior Publication Data

US 2013/0120503 A1 May 16, 2013

(30) Foreign Application Priority Data

Nov. 15, 2011 (JP) ..... 2011-249971

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 7,156,481 | B2 * | 1/2007 | Matsuba et al. | 347/17 |
| 2005/0001881 | A1 | 1/2005 | Nakashima et al. | |
| 2010/0214334 | A1 | 8/2010 | Kusunoki et al. | |

FOREIGN PATENT DOCUMENTS

| | | | |
|---|---|---|---|
| JP | 2004-322605 | A | 11/2004 |
| WO | 2005/102708 | A1 | 11/2005 |
| WO | 2006/049982 | A2 | 5/2006 |

OTHER PUBLICATIONS

The extended European Search Report dated Feb. 8, 2013, which corresponds to EP Application No. 12192743.8-1701 and is related to U.S. Appl. No. 13/676,373.

* cited by examiner

*Primary Examiner* — Matthew Luu
*Assistant Examiner* — Erica Lin
(74) *Attorney, Agent, or Firm* — Studebaker & Brackett PC

(57) ABSTRACT

A liquid ejection apparatus includes: a gas chamber surrounding a piezoelectric element in an inkjet head; and a dry gas supply device configured to start supply of dry gas to the gas chamber before supply of electric power to the inkjet head is started, to continue the supply of the dry gas while the supply of the electric power to the inkjet head is continued, and to halt the supply of the dry gas after the supply of the electric power to the inkjet head is halted. While the dry gas supply device halts the supply of the dry gas to the gas chamber, a dry gas supply flow channel opening and closing device is closed to disconnect the dry gas supply device and the gas chamber, and a gas return flow channel opening and closing device is closed to disconnect the gas chamber and the external air.

21 Claims, 13 Drawing Sheets

LIQUID EJECTION APPARATUS AND DRIVE METHOD FOR INKJET HEAD

BACKGROUND OF THE INVENTION

1. Field of the Invention

The present invention relates to a liquid ejection apparatus and a drive method for an inkjet head, and more particularly to driving technology for a piezoelectric device arranged in an inkjet head.

2. Description of the Related Art

As drive methods for inkjet heads in inkjet recording apparatuses, there are known a piezoelectric method and a thermal method. In the piezoelectric method, ink is ejected from a nozzle by using a mechanical distortion of a piezoelectric device. In the thermal method, ink is ejected from a nozzle by using a film boiling effect of ink stored in a liquid chamber connected to the nozzle. The piezoelectric method has a beneficial effect in that the ink ejection volume and ejection velocity can be controlled more readily than the thermal method.

The piezoelectric device used in the inkjet head needs to be constituted of a piezoelectric element made of material having a high piezoelectric coefficient (electrical-mechanical transducing coefficient). For example, known materials for the piezoelectric elements include lead titanate (PT), lead zirconate titanate (PZT), and PZT doped with magnesium, manganese, cobalt, iron, nickel, niobium, scandium, tantalum, bismuth, or the like. The piezoelectric element used in the inkjet head is applied with an electric field of about several kilovolts per centimeter, in order to generate the pressure required for the ejection of ink.

Here, it is known that piezoelectric elements have a large number of defects, such as small cracks or voids, and the like. When an electric field of high intensity is applied to a piezoelectric element containing lead under conditions where water (moisture) is present, large electric current flows through the lead compound in the defective portion and the peripheral area thereof, and the location where the large electric current occurs is destroyed by Joule heat and hence creates a larger defect.

By forming the piezoelectric element with a large thickness, it is possible to avoid the occurrence of large defects which pass through the element due to the breakage; however, it becomes necessary to apply an electric field of high intensity to the piezoelectric element in order to obtain a desired pressure applied to the liquid in the liquid chamber, and hence there are concerns about increase in the electric power consumption.

Japanese Patent Application Publication No. 2004-322605 discloses an inkjet recording apparatus which is provided with a dew point control unit so as to keep the dew point in the atmosphere around the piezoelectric element and the vicinity of the piezoelectric element lower than the dew point in the environment of the inkjet recording apparatus, and describes that it is thereby possible to achieve a thin thickness of the piezoelectric element while preventing the breakage of the piezoelectric element due to application of high voltage to the piezoelectric element. More specifically, the dew point control unit includes a compressor and an air drier, which dries air compressed by the computer and supplies the dried air to a casing in which the piezoelectric element is sealed. However, in this composition, when the supply of the dried air to the casing is stopped, moisture can flow back into the casing through an inlet of the dried air and an outlet of the overflowing air. Moreover, if the atmosphere around the piezoelectric element is of high humidity before starting the supply of the dried air, then there is a problem of breakage of the piezoelectric element occurring the moment a voltage is applied to the piezoelectric element.

SUMMARY OF THE INVENTION

The present invention has been contrived in view of these circumstances, an object thereof being to provide a liquid ejection apparatus and a drive method for an inkjet head which readily prevents a piezoelectric element from breaking when a voltage is applied to the piezoelectric element, while attaining a thin film thickness of the piezoelectric element.

In order to attain the aforementioned object, the present invention is directed to a liquid ejection apparatus, comprising: an inkjet head including: a nozzle which is configured to eject liquid; a pressure chamber which is connected to the nozzle and is configured to contain the liquid to be ejected from the nozzle; a piezoelectric element which is arranged on a wall of the pressure chamber on an outer side of the pressure chamber and is configured to apply pressure to the liquid contained in the pressure chamber; and a gas chamber which surrounds the piezoelectric element and a space peripheral to the piezoelectric element; a dry gas supply device which is configured to generate dry gas having a dew point of not higher than a dew point of an atmosphere around the inkjet head, the dry gas supply device being configured to start supply of the dry gas to the gas chamber before supply of electric power to the inkjet head is started, to continue the supply of the dry gas to the gas chamber while the supply of the electric power to the inkjet head is continued, and to halt the supply of the dry gas to the gas chamber after the supply of the electric power to the inkjet head is halted; a dry gas supply flow channel which has a first end and a second end, the first end of the dry gas supply flow channel being connected to the dry gas supply device, the second end of the dry gas supply flow channel being connected to the gas chamber; a dry gas supply flow channel opening and closing device which is arranged in the dry gas supply flow channel and is configured to switch between connection and disconnection of the dry gas supply device and the gas chamber; a gas return flow channel which has a first end and a second end, the first end of the gas return flow channel being connected to the gas chamber, the second end of the gas return flow channel being open to external air; a gas return flow channel opening and closing device which is arranged in the gas return flow channel and is configured to switch between connection and disconnection of the gas chamber and the external air; and an opening and closing control device which is configured to control the dry gas supply flow channel opening and closing device and the gas return flow channel opening and closing device, wherein while the dry gas supply device halts the supply of the dry gas to the gas chamber, the opening and closing control device controls the dry gas supply flow channel opening and closing device to close to disconnect the dry gas supply device and the gas chamber, and controls the gas return flow channel opening and closing device to close to disconnect the gas chamber and the external air.

According to this aspect of the present invention, in the liquid ejection apparatus which supplies the dry gas to the gas chamber in which the piezoelectric element is arranged in the inkjet head so as to lower the dew point of the periphery of the piezoelectric element to prevent deterioration due to application of voltage to the piezoelectric element, since the dry gas supply flow channel and the gas return flow channel connected to the gas chamber are closed while the supply of the dry gas is halted, the penetration of gas including moisture into the gas chamber during a halt in the supply of the dry gas is prevented.

Preferably, when a prescribed period of time has elapsed after the dry gas supply device starts generation of the dry gas, the opening and closing control device controls the dry gas supply flow channel opening and closing device to open to connect the dry gas supply device and the gas chamber to start the supply of the dry gas to the gas chamber.

According to this aspect of the present invention, penetration of gas of high humidity into the gas chamber is prevented before the supply of the dry gas to the gas chamber is introduced.

Preferably, the liquid ejection apparatus further includes: a drive voltage application device which is configured to apply a drive voltage to the piezoelectric element, wherein when a prescribed period of time has elapsed after the dry gas supply device starts the supply of the dry gas to the gas chamber, the drive voltage application device starts application of the drive voltage to the piezoelectric element.

According to this aspect of the present invention, even if the gas chamber is in a high humidity state before the dry gas is introduced, the gas chamber is changed to a prescribed low humidity state by the time that the drive voltage is applied to the piezoelectric element, and hence breakage of the piezoelectric element upon application of the drive voltage to the piezoelectric element is prevented.

Preferably, the liquid ejection apparatus further includes: a humidity measurement device which is configured to measure a humidity in the gas chamber, wherein when the humidity in the gas chamber measured by the humidity measurement device has become not higher than a threshold humidity, the drive voltage application device starts the application of the drive voltage to the piezoelectric element.

According to this aspect of the present invention, breakage of the piezoelectric element upon application of the drive voltage is reliably prevented by applying the drive voltage to the piezoelectric element after the humidity of the gas chamber has become not higher than the prescribed threshold humidity.

Preferably, the humidity measurement device includes a humidity sensor which is arranged on a downstream side of the dry gas supply device in a flow direction of the dry gas.

According to this aspect of the present invention, it is possible to ascertain the humidity of the gas chamber on the basis of the humidity of the gas returned from the gas chamber.

Preferably, the liquid ejection apparatus further includes a moisture absorbing member which is arranged in at least one of the gas chamber, the dry gas supply flow channel and the gas return flow channel.

According to this aspect of the present invention, even if moisture penetrates inside the gas chamber when the supply of the dry gas is halted, it is possible to remove this moisture.

Preferably, the liquid ejection apparatus further includes a relief valve which is arranged in the dry gas supply flow channel.

According to this aspect of the present invention, even if the pressure inside the gas chamber rises due to a blockage in the gas return flow channel, or the like, breakage of the gas chamber and the gas chamber supply flow channel is prevented by operation of the relief valve.

Preferably, the liquid ejection apparatus includes a plurality of the inkjet heads; and a dry gas distributary flow channel which connects the dry gas supply flow channel to the respective inkjet heads.

Preferably, the liquid ejection apparatus further includes a gas tributary flow channel which connects the respective inkjet heads to the gas return flow channel.

It is also preferable that the inkjet head includes a plurality of head modules; and the liquid ejection apparatus further comprises a dry gas distributary flow channel which connects the dry gas supply flow channel to the respective head modules.

Preferably, the liquid ejection apparatus further includes a gas tributary flow channel which connects the respective head modules to the gas return flow channel.

For example, each of the dry gas distributary flow channel and the gas tributary flow channel can be formed with a manifold or a joint.

Preferably, the liquid ejection apparatus further includes a moisture absorbing member which is arranged in at least one of the dry gas distributary flow channel and the gas tributary flow channel.

According to this aspect of the present invention, even if moisture penetrates inside the at least one of the dry gas distributary flow channel and the gas tributary flow channel when the supply of the dry gas is halted, it is possible to remove this moisture.

Preferably, the dry gas supply device includes: a compression device which is configured to compress gas; a filter which is configured to remove foreign matter from the compressed gas; and an air drier which is configured to remove water content from the compressed gas that has passed through the filter.

It is also possible that the filter is incorporated in the air drier.

It is also preferable that the dry gas supply device includes a filter type air drier; and the liquid ejection apparatus further comprises a regulator which is arranged between the filter type air drier and the inkjet head.

According to this aspect of the present invention, by adopting the filter type air drier, on/off control of the air drier becomes unnecessary.

Preferably, the liquid ejection apparatus further includes at least one of a flow volume sensor and a humidity sensor arranged on a downstream side of the filter type air drier in a flow direction of the dry gas.

According to this aspect of the present invention, it is possible to detect an abnormal state where the dry gas is not supplied from the air drier.

Preferably, the dry gas supply flow channel has been degreased.

According to this aspect of the present invention, the penetration of foreign material, such as dust, into the gas chamber is prevented.

Preferably, the second end of the gas return flow channel has a gas outlet configured to discharge the dry gas flowing out from the gas chamber, the gas outlet being arranged to exterior of a print unit in which the inkjet head is arranged.

According to this aspect of the present invention, condensation on the inkjet head (and in particular, the liquid ejection surface) due to the discharged gas from the gas chamber, and the effects of the flow of the discharged gas on the ejected liquid, are prevented.

Preferably, the dew point of the dry gas is not higher than 15° C.

According to this aspect of the present invention, since the interior of the gas chamber is kept in a low humidity state, a prescribed operating life of the piezoelectric element can be ensured.

Preferably, at least one of the dry gas supply flow channel opening and closing device and the gas return flow channel opening and closing device is a normally closed type control valve which is closed while being not supplied with electric power.

According to this aspect of the present invention, since at least one of the dry gas supply flow channel and the gas return flow channel are closed when the electric power to the at least one of the dry gas supply flow channel opening and closing device and the gas return flow channel opening and closing device is turned off, then outflow of the dry gas from the gas chamber and inflow of gas having high humidity into the gas chamber are prevented while the electric power is off.

Preferably, at least one of the dry gas supply flow channel opening and closing device and the gas return flow channel opening and closing device is a latch type control valve.

According to this aspect of the present invention, there is little effect of heat generation in the at least one of the dry gas supply flow channel opening and closing device and the gas return flow channel opening and closing device when the at least one of the dry gas supply flow channel opening and closing device and the gas return flow channel opening and closing device is open.

In order to attain the aforementioned object, the present invention is also directed to a drive method for an inkjet head which comprises: a nozzle which is configured to eject liquid; a pressure chamber which is connected to the nozzle and is configured to contain the liquid to be ejected from the nozzle; a piezoelectric element which is arranged on a wall of the pressure chamber on an outer side of the pressure chamber and is configured to apply pressure to the liquid contained in the pressure chamber; and a gas chamber which surrounds the piezoelectric element and a space peripheral to the piezoelectric element and is connected with a dry gas supply flow channel and a gas return flow channel, the dry gas supply flow channel having a first end connected to a dry gas supply device and a second end connected to the gas chamber, the gas return flow channel having a first end connected to the gas chamber and a second end open to external air, the method comprising: before starting supply of electric power to the inkjet head, starting supply of dry gas to the gas chamber from the dry gas supply device through the dry gas supply flow channel, the dry gas having a dew point of not higher than a dew point of an atmosphere around the inkjet head; continuing the supply of the dry gas to the gas chamber while the supply of the electric power to the inkjet head is continued; halting the supply of the dry gas to the gas chamber after the supply of the electric power to the inkjet head is halted; and while the supply of the dry gas to the gas chamber is halted, disconnecting the dry gas supply device and the gas chamber by closing a dry gas supply flow channel opening and closing device arranged in the dry gas supply flow channel, and disconnecting the gas chamber and the external air by closing a gas return flow channel opening and closing device arranged in the gas return flow channel.

It is also possible to include a humidity measurement step of measuring a humidity inside the gas chamber, a judgment step of judging whether or not there is an abnormality in the humidity of the gas chamber, and a reporting step of reporting when it is judged that there is an abnormality in the humidity of the gas chamber in the judgment step.

According to the present invention, in the liquid ejection apparatus which supplies the dry gas to the gas chamber in which the piezoelectric element is arranged in the inkjet head so as to lower the dew point of the periphery of the piezoelectric element to prevent deterioration due to application of voltage to the piezoelectric element, since the dry gas supply flow channel and the gas return flow channel connected to the gas chamber are closed while the supply of the dry gas is halted, the penetration of gas including moisture into the gas chamber during a halt in the supply of the dry gas is prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

<General Composition of Inkjet Recording Apparatus>

Figure 1:
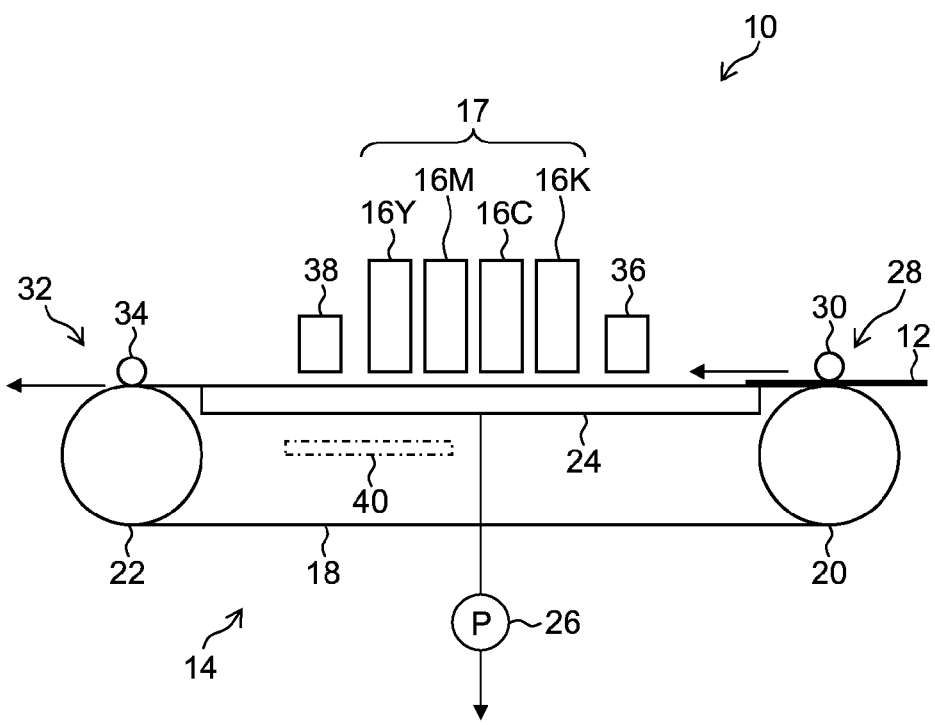
FIG. 1 is a schematic drawing showing the general composition of an inkjet recording apparatus according to an embodiment of the present invention.

FIG. 1 is a schematic drawing of an inkjet recording apparatus 10 according to an embodiment of the present invention. The inkjet recording apparatus 10 is an on-demand type of inkjet recording apparatus, and includes a recording medium conveyance unit 14 configured to hold and convey a recording medium 12, and a print unit 17 including inkjet heads 16K, 16C, 16M and 16Y configured to eject and deposit droplets of color inks corresponding to black (K), cyan (C), magenta (M) and yellow (Y) onto the recording medium 12 held on the recording medium conveyance unit 14.

The recording medium conveyance unit 14 includes: an endless conveyance belt 18, which has a plurality of suction holes (not shown) in a recording medium holding region where the recording medium 12 is held; conveyance rollers including a drive roller 20 and an idle roller 22, about which the conveyance belt 18 is wrapped; a chamber 24, which is arranged on a rear side of the conveyance belt 18 in the recording medium holding region (on the surface opposite to the recording medium holding surface where the recording medium 12 is held) and which is connected to the suction holes (not shown) that are arranged in the recording medium holding region; and a vacuum pump 26 configured to generate negative pressure in the chamber 24.

A pressing roller 30 configured to prevent the recording medium 12 from floating is arranged in a recording medium entrance 28, through which the recording medium 12 enters the inkjet recording apparatus 10, and another pressing roller 34 is arranged in a recording medium exit 32, through which the recording medium 12 is outputted.

The recording medium 12 having entered the inkjet recording apparatus 10 through the recording medium entrance 28 receives negative pressure through the suction holes of the endless conveyance belt 18 arranged in the recording medium holding region, and is thereby held by suction onto the recording medium holding region of the conveyance belt 18.

A temperature adjustment unit 36 configured to adjust the surface temperature of the recording medium 12 to a prescribed range is arranged on the conveyance path of the recording medium 12, in a stage prior to the print unit 17 (to the upstream side in terms of the recording medium conveyance direction). An image reading device (sensor) 38 configured to read an image recorded on the recording medium 12 is arranged in a stage after the print unit 17 (to the downstream side in terms of the recording medium conveyance direction).

The recording medium 12 having entered the inkjet recording apparatus 10 through the recording medium entrance 28 is held by suction on the recording medium holding region of the conveyance belt 18, is then subjected to the temperature adjustment processing by the temperature adjustment unit 36, and is then subjected to image recording carried out by the print unit 17.

As shown in FIG. 1, the inkjet heads 16K, 16C, 16M and 16Y are arranged in this order from the upstream side of the recording medium conveyance direction. The inkjet heads 16K, 16C, 16M and 16Y are configured to eject and deposit droplets of the inks of respective colors of K, C, M and Y onto the recording medium 12 while the recording medium 12 is being conveyed below the inkjet heads, and to thereby form a desired color image on the recording medium 12.

The print unit 17 is not limited to the mode described above. For example, it is also possible that the print unit 17 further includes inkjet heads 16LC and 16LM corresponding to inks of light cyan (LC) and light magenta (LM), respectively. Moreover, the arrangement order of the inkjet heads 16K, 16C, 16M and 16Y can be changed appropriately.

The recorded image (or a test pattern) is read out by the image reading device 38, and the recording medium 12 on which the image has been recorded is then outputted through the recording medium exit 32.

The inkjet recording apparatus 10 shown in FIG. 1 has a ventilation mechanism configured to supply dry gas to the periphery of piezoelectric elements 56 (shown in FIG. 6) arranged in the inkjet heads 16K, 16C, 16M and 16Y, so as to set the atmosphere around the piezoelectric elements to a low humidity state. A gas outlet 40 depicted with single-dotted lines in FIG. 1 is an end opening to the external air, of a return flow channel 82 (shown in FIG. 7) connected to a gas chamber 60 (shown in FIG. 7) to which dry gas is supplied. The details of this ventilation function are described below.

<Composition of Print Unit>

Figure 2:
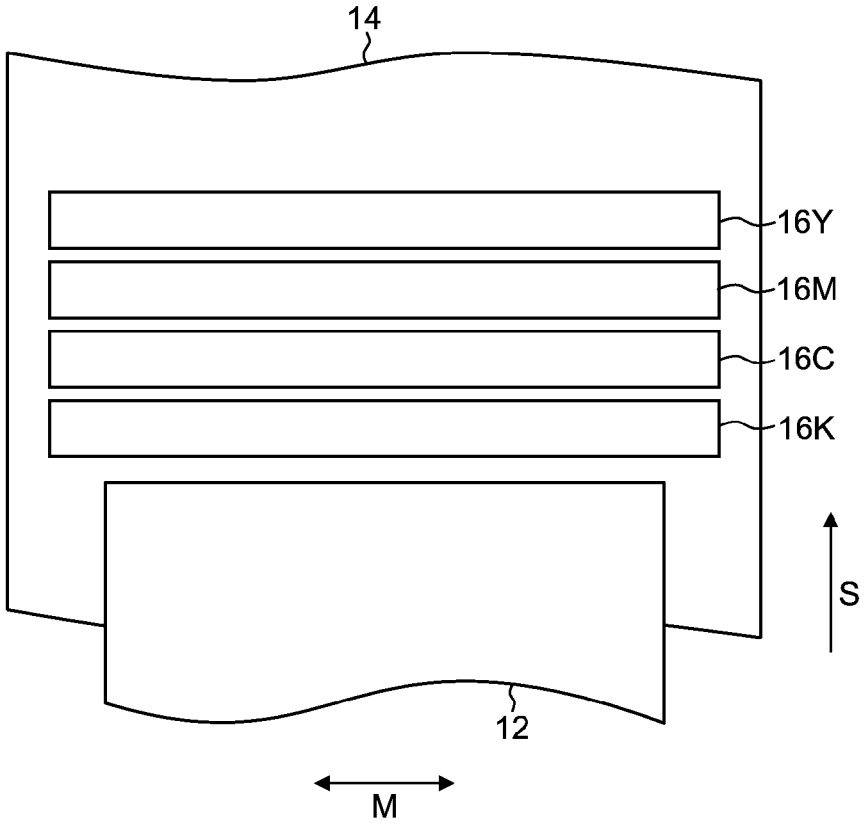
FIG. 2 is a plan diagram showing the composition of a print unit in the inkjet recording apparatus shown in FIG. 1.

FIG. 2 is a plan diagram showing the composition of the print unit 17 in the present embodiment, as viewed from an image formation surface side of the recording medium 12. As shown in FIG. 2, each of the inkjet heads 16K, 16C, 16M and 16Y is a full line head having a plurality of nozzles 50 (shown in FIG. 5) through a length corresponding to the full width of the recording medium 12. It is possible to form an image over the whole area of the recording medium 12 by performing just one relative scanning action of the inkjet heads 16K, 16C, 16M and 16Y with respect to the recording medium 12.

The "full width" in the recording medium 12 can be the full dimension of the recording medium 12 in a main scanning direction M, which is perpendicular to the conveyance direction of the recording medium 12 (i.e., a sub-scanning direction S). In a case of taking account of the margins, the "full width" can be set as the full dimension in the main scanning direction M, of the image formation region where an image is formed in the recording medium 12.

Figure 3:
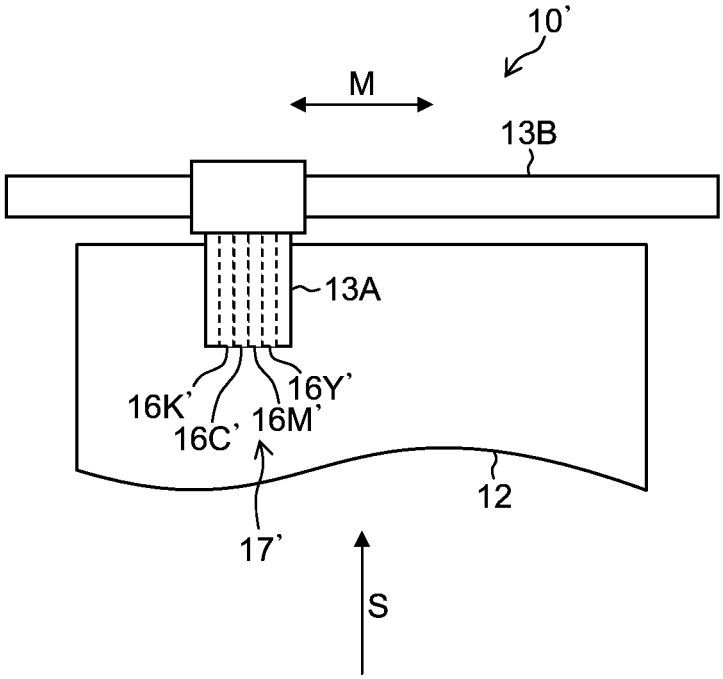
FIG. 3 is a plan diagram showing the composition of a print unit in an inkjet recording apparatus according to another embodiment of the present invention.

FIG. 3 is a plan diagram showing the composition of a print unit 17' in an inkjet recording apparatus 10' according to another embodiment. The print unit 17' shown in FIG. 3 employs a so-called serial method. More specifically, each of the inkjet heads 16K', 16C', 16M' and 16Y' has a structure in which a plurality of nozzles 50 (shown in FIG. 6) are arranged in one row or a plurality of rows along the sub-scanning direction S. The inkjet heads 16K', 16C', 16M' and 16Y' are arranged in this order along the main scanning direction M and are installed on a carriage 13A.

Image formation in the main scanning direction M is carried out by ejecting and depositing droplets of inks from the inkjet heads 16K', 16C', 16M' and 16Y' onto the recording medium 12 while moving the carriage 13A along a guide 13B in the main scanning direction M. When the image formation is completed in a particular region of the recording medium 12, the recording medium 12 is moved by a prescribed amount in the sub-scanning direction S, and the image formation is carried out in the next region. An image can be formed over the whole region of the recording medium 12 by repeating these operations.

In the present invention, it is possible to use the line heads shown in FIG. 2, and it is also possible to use the serial heads shown in FIG. 3. In the description given below, a mode in which the line heads are used is described.

<Composition of Inkjet Heads>

Figure 4:
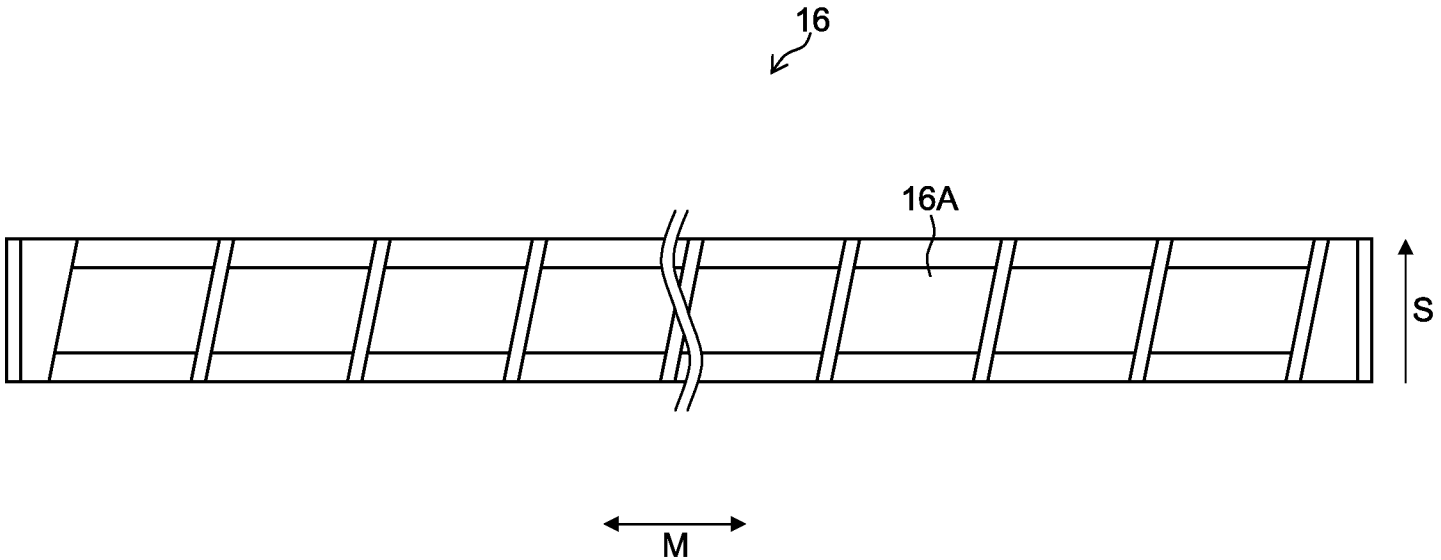
FIG. 4 is a perspective plan diagram showing the structure of the inkjet head shown in FIG. 2.

FIG. 4 is a perspective plan diagram showing the structure of each of the inkjet heads 16K, 16C, 16M and 16Y arranged in the print unit 17 (as viewed from the side opposite to the ink ejection surface) in the present embodiment. The inkjet heads 16K, 16C, 16M and 16Y shown in FIG. 1 can employ the same structure, and hence in the description given below, there are cases where the inkjet heads 16K, 16C, 16M and 16Y are denoted with a common reference numeral 16.

The inkjet head 16 shown in FIG. 4 has a structure in which a plurality of head modules 16A are joined together in the main scanning direction M. Each head module 16A has a flow channel structure in which the head module can function as an inkjet head.

Figure 5:
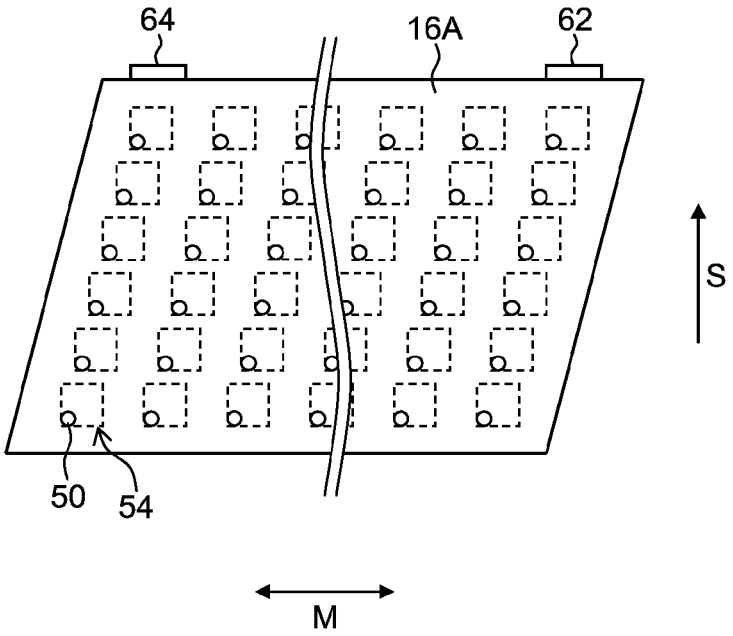
FIG. 5 is a plan perspective diagram showing a nozzle arrangement in the head module shown in FIG. 4.

FIG. 5 is a plan perspective diagram showing a nozzle arrangement of the head modules 16A shown in FIG. 4, and shows an extracted view of one of the head modules 16A shown in FIG. 4. The head module 16A is provided with a dry gas supply port 62 and a gas return port 64 of the gas chamber 60 (shown in FIG. 6) described below. The head module 16A shown in FIG. 5 has a structure in which the nozzles 50 (ejection elements) are arranged in a matrix configuration along a row direction following the main scanning direction M and a column direction oblique to the main scanning direction M and the sub-scanning direction S. By arranging the nozzles 50 in the matrix configuration as shown in FIG. 5, the effective nozzle arrangement density in the main scanning direction M is made high. The nozzle arrangement in the inkjet heads to which the present invention can be applied is not limited to the matrix arrangement shown in FIG. 5. For example, it is possible to adopt a mode where the nozzles 50 are arranged in a single row along the lengthwise direction of the inkjet head 16, a mode where the nozzles 50 are arranged in two staggered rows along the lengthwise direction of the inkjet head 16, or the like.

Figure 6:
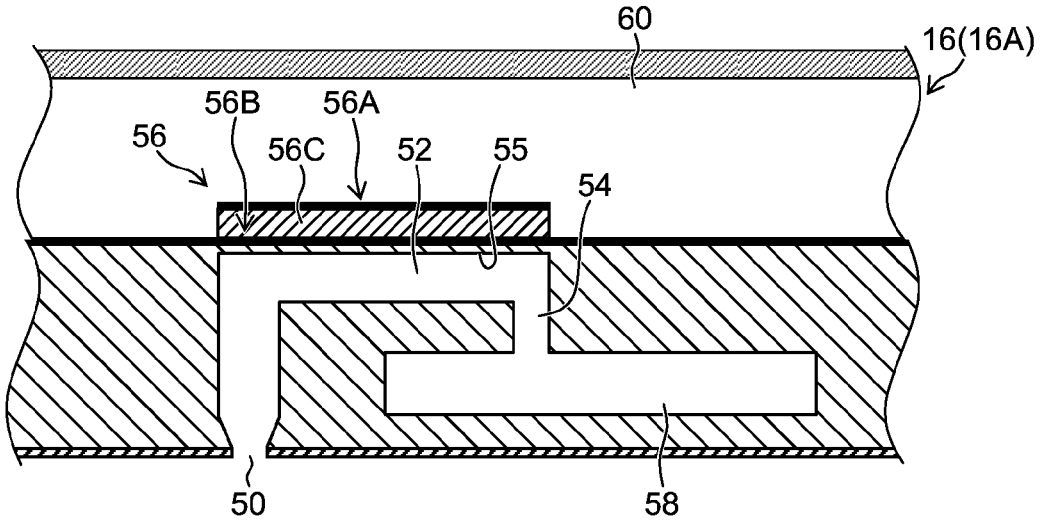
FIG. 6 is a cross-sectional diagram showing the inner structure of one ejection element in the inkjet head shown in FIG. 2.

FIG. 6 is a cross-sectional diagram showing the inner structure of one ejection element in the inkjet head 16 (the head module 16A). As shown in FIG. 6, the inkjet head 16 (head module 16A) includes: the nozzle 50, through which droplets of ink are ejected; a pressure chamber 52, which is connected to the nozzle 50; a diaphragm 55, which constitutes a ceiling face of the pressure chamber 52; and a piezoelectric element 56, which is arranged on the diaphragm 55.

The pressure chamber 52 is connected to a common flow channel 58 through a supply port (supply restrictor) 54. The common flow channel 58 is connected through a flow channel, and the like, to an ink tank (not shown) arranged on the exterior of the inkjet head 16.

The piezoelectric element 56 has a structure in which a piezoelectric body 56C is arranged between an upper electrode 56A and a lower electrode 56B, and produces mechanical distortion when a drive voltage is applied between the upper electrode 56A and the lower electrode 56B. The mechanical distortion of the piezoelectric element 56 causes the pressure chamber 52 to deform, thereby causing ink contained in the pressure chamber 52 to be ejected from the nozzle 50. When the distorted piezoelectric element 56 is restored to the original state, the interior of the pressure chamber 52 is refilled with ink from the common flow channel 58 through the supply port 54. If the diaphragm 55 is made of a metal material, the diaphragm 55 can also serve as the lower electrode 56B.

The inkjet head 16 shown in FIG. 6 has a structure in which a plurality of cavity plates are layered together. For example, there is a mode where a nozzle plate in which opening sections 50A of the nozzles 50 are formed, a flow channel plate in which the pressure chambers 52, the supply ports 54, the common flow channel 58, and the like, are formed, the diaphragm, and the piezoelectric elements 56 are layered in this order. It is also possible to compose each of the above-described plates by a plurality of plates.

As shown in FIG. 6, the inkjet head 16 is provided with the gas chamber 60, which covers the space where the piezoelectric element 56 is arranged. The gas chamber 60 functions as a cover for the piezoelectric element 56, and also functions as a wall that divides the space to which the dry gas (described in detail below) is supplied, from the other space.

The gas chamber 60 arranged for each head module 16A can be supplied and filled with dry gas through the dry gas supply port 62 shown in FIG. 5. When the supplied dry gas exceeds the volume of the gas chamber 60, then the gas is expelled to the exterior from the gas chamber 60 through the gas return port 64.

The gas chamber 60 can have a structure configured to collectively cover all of the piezoelectric elements 56 arranged in the head module 16A, or can have a structure including a plurality of compartments. Furthermore, it is also possible to adopt a mode in which one integrated gas chamber 60 is arranged for a plurality of head modules 16A.

In the structure in which the gas chamber 60 is divided into compartments, it is possible that the gas chamber 60 is divided in accordance with the arrangement of the piezoelectric elements 56. It is also possible to adopt a mode in which one compartment of the gas chamber 60 is used for one row of the piezoelectric elements 56 arranged in an oblique direction (see FIG. 5), or a mode in which one compartment corresponds to a plurality of rows of the piezoelectric elements 56.

It is possible to form the gas chamber 60 in a layering process when forming the inkjet head 16, or alternatively, it is also possible that a separately formed gas chamber 60 is bonded to the inkjet head 16.

<Description of Dry Gas Supply Unit>

Next, a dry gas supply unit configured to supply dry gas to the gas chamber 60 of the inkjet head 16 is described in detail.

Figure 7:
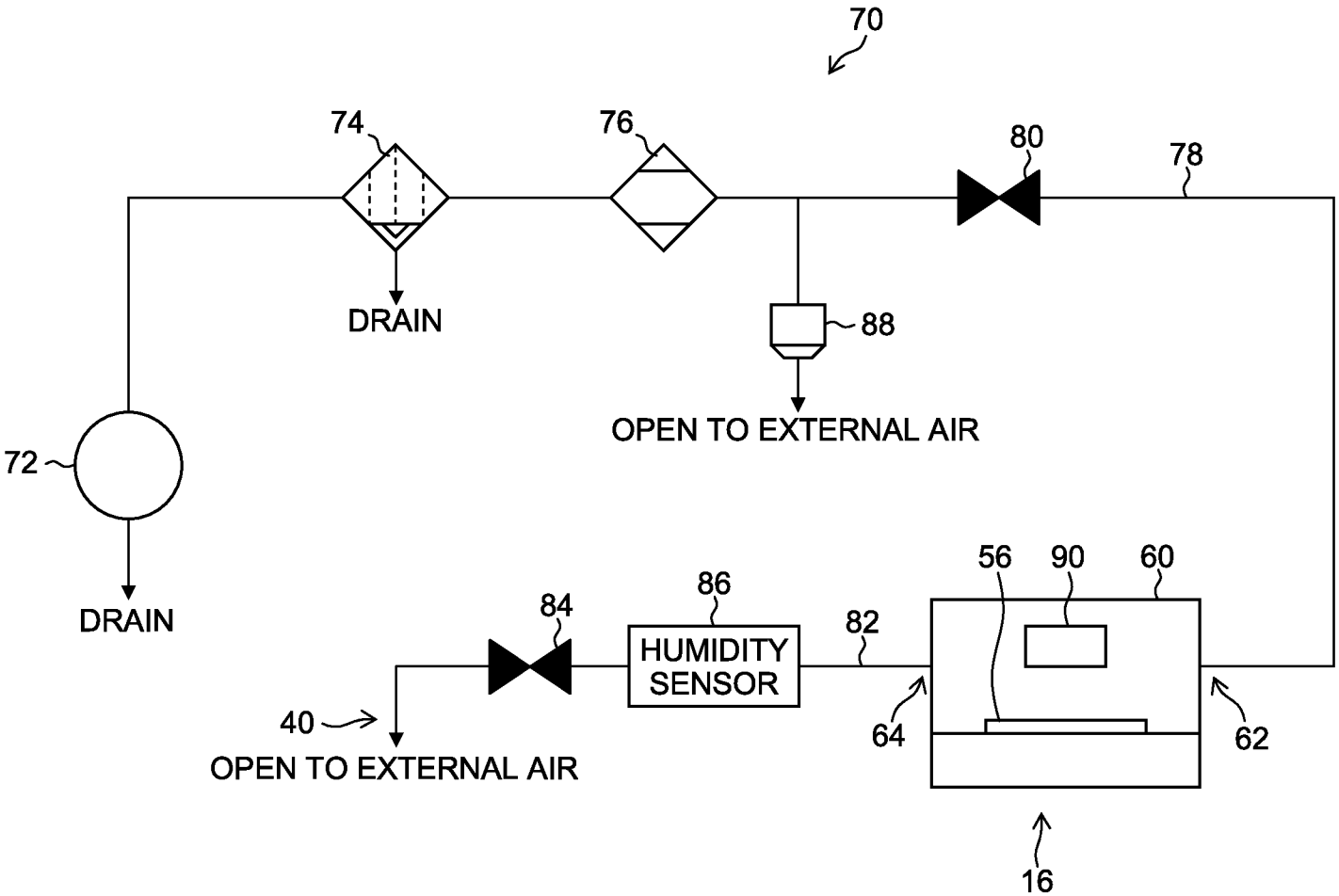
FIG. 7 is a block diagram showing the general composition of a dry gas supply unit.

FIG. 7 is a block diagram showing the general composition of the dry gas supply unit 70. The dry gas supply unit 70 functions as a device configured to ventilate the gas chamber 60 to set the atmosphere around the piezoelectric elements 56 to a low humidity state. In the following description, parts which are the same as or similar to the parts described above are denoted with the same reference numerals and further explanation thereof is omitted here.

The dry gas supply unit 70 shown in FIG. 7 is configured to supply dry gas (for example, air) to the gas chamber 60 arranged in the inkjet head 16 so as to keep the dew point of the gas surrounding the piezoelectric elements 56 to be not higher than a prescribed temperature.

In the present embodiment, the "dry gas" is defined as a gas of which the dew point is not higher than −4.4° C., and displays a function of reducing the humidity in the atmosphere by absorbing moisture in the atmosphere. The dew point of the dry gas can be determined by direct measurement using a dew point thermometer, or by calculation to obtain the water vapor pressure from the gas temperature and the relative humidity of the gas and then determine the temperature at which the obtained water vapor pressure is equal to the saturation pressure of water vapor.

More specifically, the dry gas supply unit 70 includes: a compressor 72 configured to generate compressed air; a filter 74 configured to remove foreign material, such as dirt, from the compressed air generated by the compressor 72; and an air drier 76 configured to generate dry air from the compressed air from which the foreign material has been removed by the filter 74.

The air drier 76 is connected to the gas chamber 60 at the dry gas supply port 62 through a dry gas supply flow channel 78. The dry gas supply flow channel 78 is provided with a supply flow valve 80, which can be switched between connection and disconnection of the air drier 76 and the gas chamber 60.

When the dry gas is supplied to the gas chamber 60, the supply flow valve 80 is opened and the dry gas is introduced into the gas chamber 60 from the air drier 76. On the other hand, when the supply of dry gas to the gas chamber 60 is halted, the supply flow valve 80 is closed. While the supply of dry gas to the gas chamber 60 is halted, the closure of the supply flow valve 80 prevents moisture from penetrating into the gas chamber 60 that is in the low humidity state.

The gas return port 64 of the gas chamber 60 is connected to one end of the return flow channel 82, and the other end of the return flow channel 82 is open to the external air at the gas outlet 40. The return flow channel 82 is provided with a return flow valve 84, which can be switched between connection and disconnection of the gas chamber 60 and the external air.

The gas outlet 40, which is the end of the return flow channel 82 that is open to the external air, is arranged to the outside of the print unit 17 as shown in FIG. 1, and it is hence possible to prevent the condensation on the ink ejection surface due to the gas that has the possibility of including moisture returned from the gas chamber 60 passing into the print unit 17 and the vicinity of the ink ejection surface of the inkjet head 16, and also to prevent the ejected ink droplets from being affected by the flow of the gas.

In the inkjet recording apparatus in the related art (e.g., in Japanese Patent Application Publication No. 2004-322605), there are concerns about condensation on the nozzle surface due to air having high humidity expelled from the casing. Furthermore, there are also concerns about the effects of the flow of air on the periphery of the nozzles. According to the present embodiment, these problems can be resolved by arranging the gas outlet 40, which is the end of the return flow channel 82 open to the external air, to the exterior of the print unit 17.

When the dry gas is supplied to the gas chamber 60, the return flow valve 84 is opened, thereby preventing the interior of the gas chamber 60 from assuming a high pressure. When the supply of dry gas to the gas chamber 60 is halted, the return flow valve 84 is closed. While the supply of dry gas to the gas chamber 60 is halted, the closure of the return flow valve 84 prevents reverse flow of moisture from the external air into the gas chamber 60 that is in the low humidity state.

The return flow channel 82 is provided with a humidity sensor 86 configured to measure the humidity of the gas returned from the gas chamber 60 to obtain humidity information. The humidity in the gas chamber 60 is ascertained on the basis of the humidity information obtained through the humidity sensor 86.

The dry gas supply flow channel 78 is provided with a relief valve 88 arranged between the air drier 76 and the supply flow valve 80. If the pressure inside the gas chamber 60 is greater than a threshold pressure, for instance, due to blockage of the gas return port 64 on the gas chamber 60, then the relief valve 88 opens and the dry gas supply flow channel 78 is opened to the external air, and breakage of the gas chamber 60, and the like, is prevented.

In the inkjet recording apparatus in the related art (e.g., in Japanese Patent Application Publication No. 2004-322605), if the discharge port of the casing is blocked, the interior of the casing assumes a high pressure and hence there is a risk of mechanical breakage of the inkjet head. According to the present embodiment, this problem can be resolved by arranging the relief valve 88 on the dry gas supply flow channel 78 between the air drier 76 and the supply flow valve 80.

The compressor 72 introduces compressed air of about 0.5 MPa into the air drier 76. The compressor 72 has a drain for water condensed when the air is compressed.

The filter 74 can employ a composition including an air filter, which removes dust from the air, and an oil filter, which removes an oil component from the air. It is also possible to adopt a mode in which the filter 74 is incorporated into the air drier 76. The filter 74 has a drain for water and captured dust and oil component.

The air drier 76 employs a cooling air drier which removes the water content in the air by lowering the temperature of the air. It is also possible that the air drier 76 employs a moisture absorption type of air drier. The dry gas generated by the air drier 76 is introduced into the gas chamber 60 through the dry gas supply flow channel 78 and the dry gas supply port 62.

It is desirable that the dry gas supply flow channel 78 has been degreased. It is further desirable that the flow channel pipes and members on the upstream side of the gas chamber 60 in terms of the flow direction of the gas have been degreased.

The supply flow valve 80 arranged in the dry gas supply flow channel 78 and the return flow valve 84 arranged in the return flow channel 82 can employ control valves which are controllable to open and close by control signals (for example, electromagnetic valves). It is also possible that at least one of the supply flow valve 80 and the return flow valve 84 employs a manual valve, which is manually opened and closed.

Each of the supply flow valve 80 and the return flow valve 84 can employ any of a normally closed type, normally open type and latch type of valve. It is desirable that the supply flow valve 80 and the return flow valve 84 employ the normally closed type of valves, which are closed while electric power is not supplied. It is thereby possible that, while the electric power is off, the dry gas supply flow channel 78 and the gas chamber 60 are disconnected, the return flow channel 82 and the gas chamber 60 are also disconnected, and therefore outflow of dry gas from the gas chamber 60 and inflow of gas having high humidity into the gas chamber 60 are prevented. It is also desirable that the supply flow valve 80 and the return flow valve 84 employ the latch type of valves, which have little effects of heat generation when opened.

The humidity sensor 86 is arranged in order to monitor whether or not the dry gas is being supplied to the gas chamber 60. The humidity sensor 86 is arranged at a downstream side of the air drier 76 in terms of the flow direction of the gas, and more desirably, at a downstream side of the gas chamber 60.

A moisture absorbing member 90 is arranged in the gas chamber 60. While the dry gas is not being supplied to the gas chamber 60, even if moisture penetrates into the gas chamber 60 through gaps, the moisture absorbing member 90 absorbs this moisture and keeps the humidity inside the gas chamber 60 uniform. The moisture absorbing member 90 is installed on a wall which constitutes the gas chamber 60. The moisture absorbing member 90 can be restored to have prescribed moisture absorbing properties by passing the dry gas in the gas chamber 60.

Although FIG. 7 shows a mode where the moisture absorbing member 90 is arranged in the gas chamber 60, it is also possible to adopt a mode where the moisture absorbing member 90 is arranged in the dry gas supply flow channel 78, the moisture absorbing members 90 are arranged in both the gas chamber 60 and the dry gas supply flow channel 78.

In other words, it is preferable that the moisture absorbing member 90 is arranged in the path of dry gas (including the gas chamber 60), from the supply flow valve 80 to the return flow valve 84.

Although the dried air (which has undergone the moisture removal process) is employed as the dry gas supplied to the gas chamber 60 in the present embodiment, it is also possible to employ an inert gas, such as nitrogen or argon, or the like as the dry gas. The dry gas employed in the present embodiment has the dew point of not higher than −15° C., and the dew point of the gas in the gas chamber 60 is not higher than −4.4° C.

The reference value of the "dew point of dry gas" described above can be determined from the ambient conditions when the operating life of the piezoelectric elements 56 (see FIG. 6) has been estimated empirically by accelerated life test. Table 1 shows the results of the accelerated life test.

TABLE 1

| Relative humidity of drygas at 30° C. (%) | Dew point of dry gas (° C.) | Estimated operating life of piezoelectric elements (years) |
|---|---|---|
| 75 | 25.0 | $7.4 \times 10^{-2}$ |
| 70 | 23.9 | $1.1 \times 10^{-1}$ |
| 65 | 22.7 | $1.7 \times 10^{-1}$ |
| 60 | 21.4 | $2.8 \times 10^{-1}$ |
| 55 | 20.0 | $5.0 \times 10^{-1}$ |
| 50 | 18.4 | 1.0 |
| 45 | 16.8 | 2.5 |
| 40 | 14.9 | 7.5 |
| 35 | 12.9 | $3.1 \times 10^{1}$ |
| 30 | 10.5 | $2.0 \times 10^{2}$ |
| 25 | 7.8 | $2.9 \times 10^{3}$ |
| 20 | 4.6 | $1.5 \times 10^{5}$ |
| 15 | 0.6 | $1.1 \times 10^{8}$ |
| 10 | −4.4 | $5.9 \times 10^{13}$ |
| 5 | −12.3 | $9.4 \times 10^{30}$ |

As shown in Table 1, under the conditions where the relative humidity is 40% at the ambient temperature of 30° C. (i.e., the dew point of dry gas is 14.9° C.), the operating life of the piezoelectric elements is estimated to be about 7.5 years.

According to these test results, if the dew point of the dry air for removing moisture from the periphery of the piezoelectric elements 56 is not higher than 15° C. (14.9° C.), then it is possible to obtain the operating life of the piezoelectric elements that is sufficient in practical terms.

Moreover, using a module incorporating the moisture absorbing member 90 (the structure corresponding to the inkjet head 16 shown in FIG. 7), the module was filled with the dry gas, the module was then immersed in water in a state where the supply of dry gas had been stopped and the relative humidity inside the module was measured. The time taken for the humidity of the air inside the module to reach the aforementioned relative humidity of 40% was evaluated and results shown in Table 2 were obtained.

TABLE 2

| Relative humidity of dry gas at 30° C. (%) | Dew point of dry gas (° C.) | Time to reach 40% relative humidity inside module after halt of dry gas supply (months) |
|---|---|---|
| 40 | 14.9 | 0 |
| 35 | 12.9 | 0.5 |
| 30 | 10.5 | 1.0 |
| 25 | 7.8 | 1.5 |
| 20 | 4.6 | 2.0 |
| 15 | 0.6 | 2.5 |
| 10 | −4.4 | 3.0 |
| 5 | −12.3 | 3.5 |

As shown in Table 2, if the relative humidity of dry gas is not higher than 10% (the dew point is not higher than −4.4° C.) at first, it is possible to maintain the relative humidity of the air inside the module at not higher than 40% for three months after the supply of dry gas is halted, and it is possible to obtain an allowable period of halting supply of dry gas that is sufficient in practical terms. It is considered that the lower the relative humidity of dry gas supplied to the module, the drier the state of the moisture absorbing member arranged in the module. More specifically, if the dew point of dry gas supplied to the gas chamber 60 is not higher than −4.4° C., then it is possible to obtain the allowable period of halting supply of dry gas that is sufficient in practical terms.

<Explanation of Control System>

Figure 8:
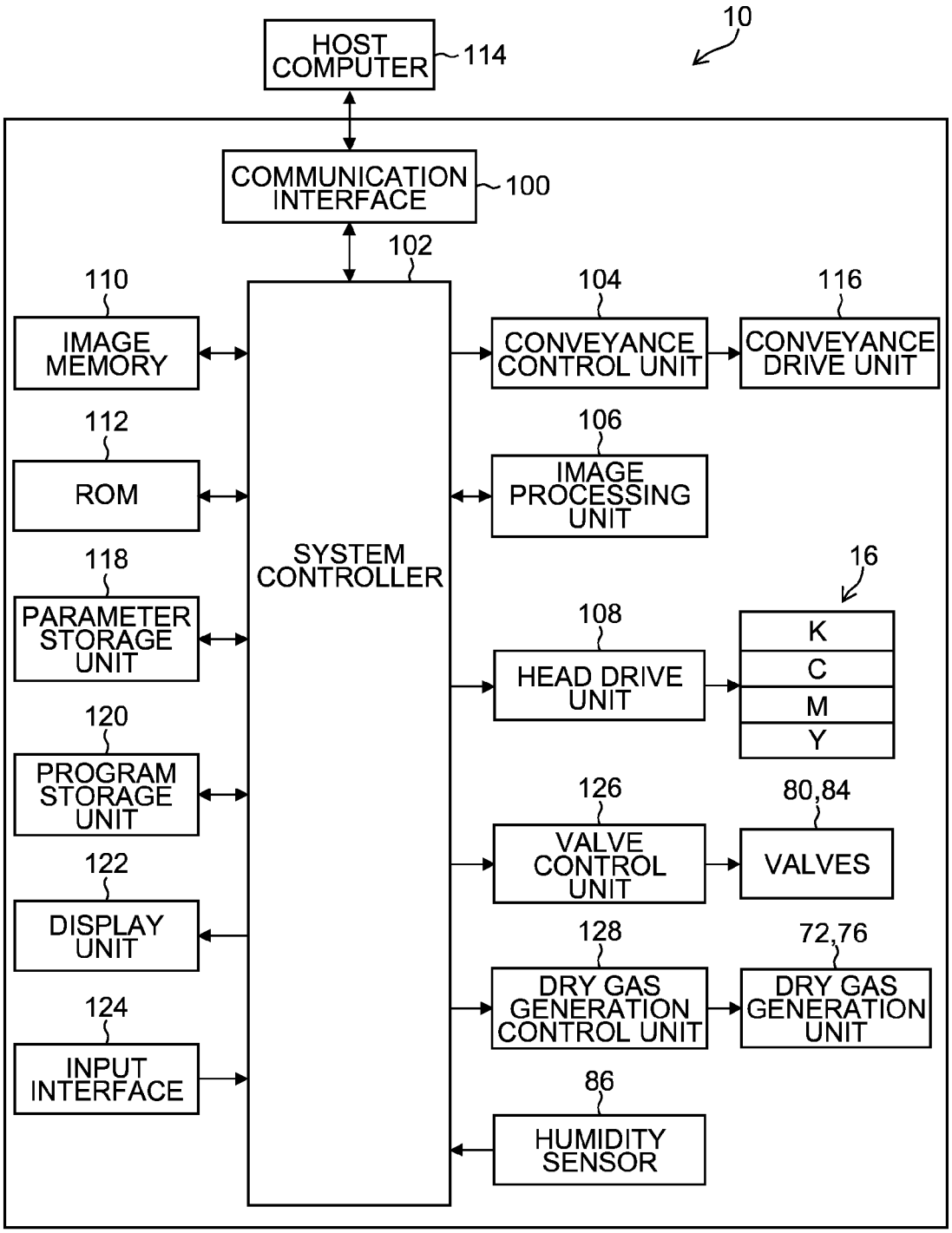
FIG. 8 is a block diagram showing the general composition of a control system in the inkjet recording apparatus shown in FIG. 1.

FIG. 8 is a block diagram showing the general composition of the control system of the inkjet recording apparatus 10. As shown in FIG. 8, the inkjet recording apparatus 10 includes a communication interface 100, a system controller 102, a conveyance control unit 104, an image processing unit 106, and a head driving unit 108, an image memory 110 and a ROM 112.

The communication interface 100 is an interface unit for receiving raster image data transmitted from a host computer 114. The communication interface 100 can employ a serial interface, such as a USB (Universal Serial Bus), or a parallel interface, such as a Centronics device. It is also possible to install a buffer memory (not shown) for achieving high-speed communications in the communication interface 100.

The system controller 102 is constituted of a central processing unit (CPU) and peripheral circuits of same, and the like, and functions as a control device which controls the whole of the inkjet recording apparatus 10 in accordance with a prescribed program, as well as functioning as a calculating device which performs various calculations and also functioning as a memory controller for the image memory 110 and the ROM 112.

More specifically, the system controller 102 controls the various sections, such as the communication interface 100, the conveyance control unit 104, and the like, as well as controlling communications with the host computer 114 and read and writing to and from the image memory 110 and the ROM 112, and the like, and generating control signals which control the respective units described above.

The image data sent from the host computer 114 is inputted to the inkjet recording apparatus 10 through the communication interface 100, and prescribed image processing is carried out by the image processing unit 106.

The image processing unit 106 is a control unit which has signal (image) processing functions for carrying out various treatments, corrections and other processing in order to generate a signal for controlling printing from the image data, and which supplies the generated print data (dot data) to the head drive unit 108.

When prescribed signal processing has been carried out in the image processing unit 106, the volume of droplet to be ejected (droplet ejection volume) and the ejection timing of the inkjet head 16 are controlled through the head drive unit 108 on the basis of the print data (halftone image data).

Thereby, desired dot sizes and dot arrangements are achieved. The head drive unit 108 shown in FIG. 8 can also include a feedback control system for maintaining uniform drive conditions in the inkjet head 16.

The conveyance control unit 104 controls the conveyance timing and conveyance speed of the recording medium 12 (see FIG. 1) on the basis of print data generated by the image processing unit 106. The conveyance drive unit 116 in FIG. 8 includes a motor which drives the drive roller 20 of the recording medium conveyance unit 14 that conveys the recording medium 12, and the conveyance control unit 104 functions as a driver for this motor.

The image memory (temporary storage memory) 110 has the functions of a temporary storage device for temporarily storing the image data inputted through the communication interface 100, and the functions of a development area for various programs stored in the ROM 112 and a calculation work area for the CPU (for example, a work area for the image processing unit 106). A volatile memory (RAM) which can be read from and written to sequentially is used as the image memory 110.

The ROM 112 stores the program which is executed by the CPU of the system controller 102, and various data and control parameters, and the like, which are necessary for controlling the respective sections of the inkjet recording apparatus 10, and performs reading and writing of data through the system controller 102. The ROM 112 is not limited to a memory constituted of semiconductor devices, and can also employ a magnetic medium, such as a hard disk. Furthermore, the storage unit can also include an external interface and use a detachable storage medium.

The parameter storage unit 118 stores various control parameters which are necessary for the operation of the inkjet recording apparatus 10. The system controller 102 reads out parameters required for control purposes, as appropriate, and updates (rewrites) parameters as and where necessary.

The program storage unit 120 is a storage device which stores the control programs for operating the inkjet recording apparatus 10. In controlling the respective units of the inkjet recording apparatus 10, the system control unit 102 (or respective units of the inkjet recording apparatus 10 themselves) reads out the required control program from the program storage unit 120 and the control program is duly executed.

The display 122 is a device which displays various information sent from the system controller 102, and employs a generic display device, such as an LCD monitor. The display mode of the display unit 122 can employ lighting of lamps (flashing, switching off). Moreover, it is also possible that the display unit 122 is provided with a sound (voice) output device, such as a speaker.

An input interface 124 employs an information input device, such as a keyboard, mouse, joystick, or the like. The information inputted through the input interface 124 is sent to the system controller 102.

A valve control unit 126 sends control signals to the supply flow valve 80 and the return flow valve 84 shown in FIG. 7 on the basis of command signals sent from the system controller 102, thereby controlling the opening and closing operation of the supply flow valve 80 and the return flow valve 84.

A dry gas generation control unit 128 controls operation of the compressor 72 and the air drier 76 shown in FIG. 7 by sending control signals on the basis of command signals sent from the system controller 102.

More specifically, when the dry gas is generated to be sent into the gas chamber 60, the compressor 72 is operated, compressed air is introduced into the air drier 76, the air drier 76 is operated, and the dry gas is generated. In other words, the compressor 72 and the air drier 76 function as the dry gas generation unit.

The humidity sensor 86 measures the humidity of the gas returned from the gas chamber 60 and sends the measurement results (humidity information) to the system controller 102. The system controller 102 judges whether or not there is an abnormality in the humidity inside the gas chamber 60 on the basis of the humidity information obtained from the humidity sensor 86. If there is an abnormality in the humidity in the gas chamber 60, an error message is displayed on the display unit 122.

<Description of Ventilation Function>

Next, the ventilation function employed in the inkjet recording apparatus 10 (inkjet head 16) according to the present invention is described in detail. The ventilation function described below keeps the atmosphere around the piezoelectric elements 56 arranged in the inkjet head 16 to a low-humidity state in order to avoid performance deterioration or breakage of the piezoelectric elements 56 due to application of the drive voltage, which can readily occur in a state of high humidity.

The low-humidity state is a state where the humidity is at least lower than the peripheral humidity of the print unit 17 (17'), and desirably a state where the dew point is not higher than −4.4° C.

When the ventilation function is halted, the supply flow valve 80 of the dry gas supply flow channel 78 and the return flow valve 84 of the return flow channel 82 are closed so as to prevent moisture from penetrating into the gas chamber 60 while the supply of dry gas to the gas chamber 60 is halted.

Thus, by preventing penetration of moisture into the gas chamber 60 while the supply of dry gas is halted, then even if the inkjet head 16 (piezoelectric elements 56) is operated while the ventilation function is halted or immediately after starting implementation of the ventilation function, the piezoelectric elements 56 are prevented from breaking the moment they start operation.

Figure 9:
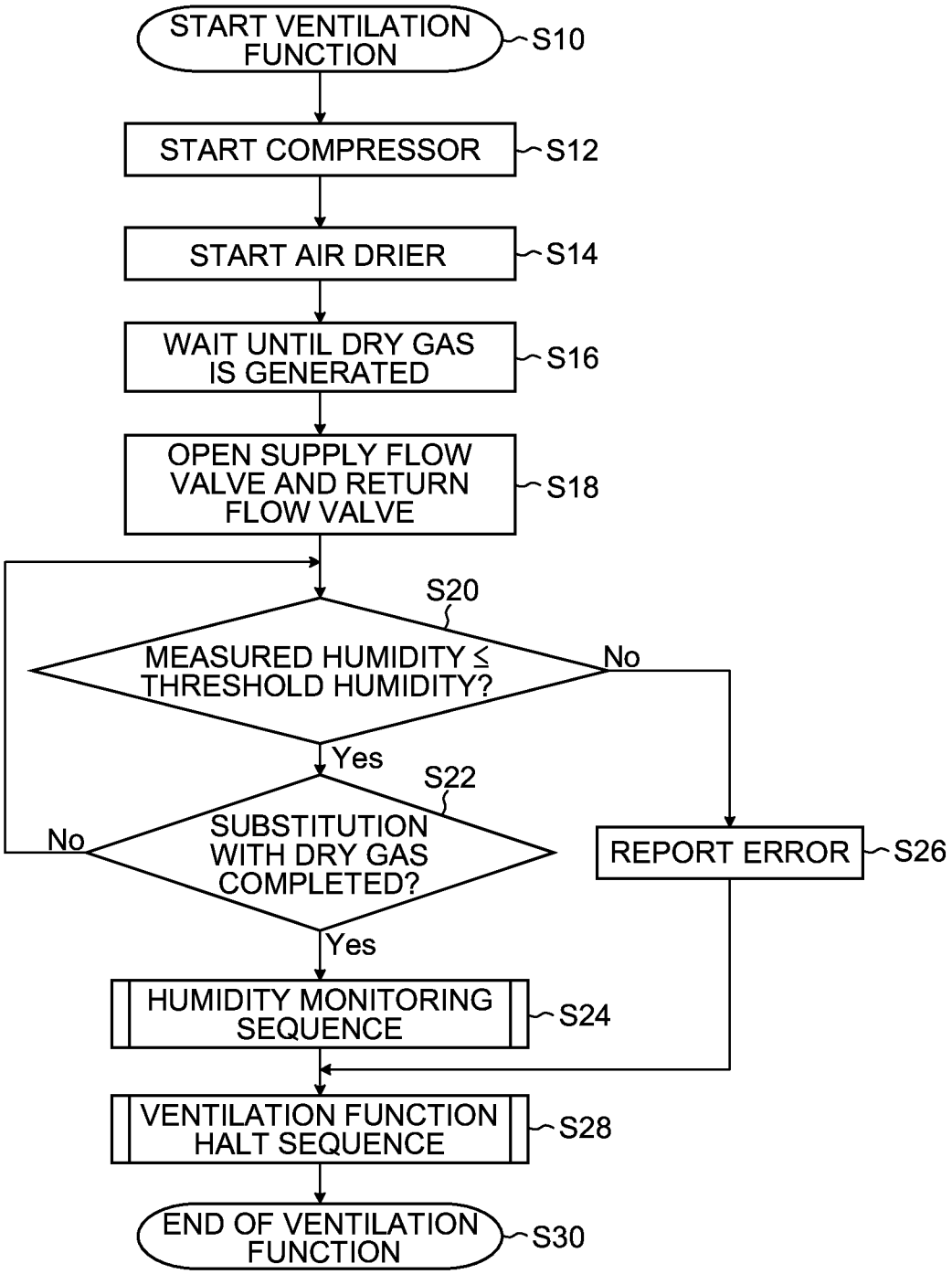
FIG. 9 is a flowchart showing a flow of control of a ventilation function.

FIG. 9 is a flowchart showing a flow of control of the ventilation function. The ventilation function described below is started when the power of the inkjet recording apparatus 10 is turned on, and is implemented continuously while the electric power is supplied to the inkjet head 16. The ventilation function can be started before the supply of the electric power to the inkjet head 16 is started, and can be halted after the supply of the electric power to the inkjet head 16 is halted.

During the operation of the inkjet head 16, the ventilation function is implemented continuously. The operation of the inkjet head 16 includes an initialization operation when starting up the inkjet recording apparatus 10 and a maintenance operation during a pause in image formation, as well as ink ejection for the purpose of image formation. More specifically, the operation of the inkjet head 16 includes cases where a voltage of any kind is applied between the upper electrode 56A and the lower electrode 56B of the piezoelectric element 56, for instance, application of voltage in order to maintain a steady state of the piezoelectric element 56, or application of voltage when causing the meniscus to vibrate without causing ink to be ejected, and so on.

As shown in FIG. 9, when the ventilation function is started (step S10), the compressor 72 shown in FIG. 7 is started up (step S12 in FIG. 9), and compressed air is introduced into the air drier 76 in FIG. 7.

Next, the air drier 76 is started (step S14 in FIG. 9), and the generation of dry gas is continued, while the inkjet recording apparatus 10 is at standby, until a prescribed volume of dry gas has been generated (step S16 in FIG. 9).

When the prescribed volume of dry gas has been generated, the supply flow valve 80 and the return flow valve 84 are opened (step S18).

Thereupon, the humidity measured by the humidity sensor 86 in FIG. 7 and a predetermined threshold humidity are compared (step S20 in FIG. 9). If the humidity measured by the humidity sensor 86 is equal to or lower than the threshold humidity (Yes verdict), the procedure advances to step S22, and it is judged whether or not the interior of the gas chamber 60 has been substituted with the dry gas.

In the ventilation function according to the present embodiment, the humidity measured by the humidity sensor 86 is regarded as the humidity of the gas in the gas chamber 60. It is also possible that the humidity of the gas in the gas chamber 60 is taken as the value obtained by multiplying the humidity measured by the humidity sensor 86 by a prescribed coefficient, or is taken as the value obtained by adding a prescribed coefficient to the humidity measured by the humidity sensor 86.

On the other hand, in step S20, if the humidity measured by the humidity sensor 86 exceeds the threshold humidity (in a high-humidity state where the measured humidity is higher than the threshold humidity) (No verdict), the procedure advances to step S26 in FIG. 9, an error is reported to indicate that the humidity has exceeded the prescribed threshold humidity, and the procedure advances to step S28. In step S20, it is judged, a plurality of times, whether or not the humidity measured by the humidity sensor 86 is exceeding the threshold humidity, and it is judged that an error of some kind has occurred if the judgment that the humidity measured by the humidity sensor 86 is exceeding the threshold humidity continues for a specific number of times.

Possible examples of the error reporting are a mode where an error message is displayed on the display unit 122 shown in FIG. 7, in step S26, or a voice-based report or lighting up (flashing) of the lamp indicating the abnormality, and so on.

When the error is reported in step S26, the procedure advances to step S28 (ventilation function halt sequence), and the ventilation function is terminated (step S30).

In step S22, if the interior of the gas chamber 60 is judged to have been substituted with the dry gas (Yes verdict), the procedure advances to step S24. On the other hand, if it is judged in step S22 that the interior of the gas chamber 60 has not been substituted with the dry gas (No verdict), then the procedure returns to step S20, and steps S20 and S22 are carried out repeatedly.

It is ascertained whether or not the interior of the gas chamber 60 has been substituted with the dry gas on the basis of the flow volume of the gas flowing in the dry gas supply flow channel 78 in FIG. 7, and the elapsed time after opening the supply flow valve 80. For example, a state where the interior of the gas chamber 60 has been substituted with the dry gas can be identified as a state where the volume of dry gas supplied to the gas chamber 60 has become equal to or greater than 100 percent of the sum of the capacity of the gas chamber 60 and the capacity of the dry gas supply flow channel 78 (the flow path leading from the air drier 76 to the gas chamber 60).

In step S24, a humidity monitoring sequence is carried out inside the gas chamber 60. More specifically, when the control is shifted to step S24, the interior of the gas chamber 60 is at a prescribed low-humidity state, and it is therefore possible to start the supply of the electric power to the inkjet head 16 to start the operation (application of voltage to the piezoelectric element 56). The details of the humidity monitoring sequence shown in step S24 are described below.

When the prescribed halt conditions are satisfied, the humidity monitoring sequence (step S24) is terminated. When the humidity monitoring sequence has been terminated, the ventilation function halt sequence (step S28) is carried out and the ventilation function is terminated (step S30).

The conditions for halting the ventilation function are, for instance, when the humidity of the gas chamber 60 has exceeded a prescribed humidity, or when the power of the inkjet recording apparatus 10 is turned off, etc.

Figure 10:
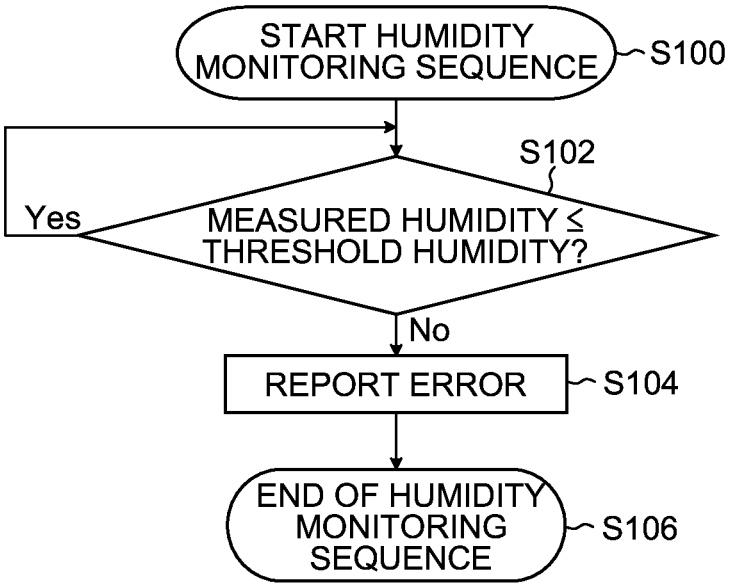
FIG. 10 is a flowchart showing a flow of a humidity monitoring sequence shown in FIG. 9.

FIG. 10 is a flowchart of the humidity monitoring sequence (step S24) in FIG. 9. When the humidity monitoring sequence shown in FIG. 10 is started (step S100), it is judged whether or not the humidity measured by the humidity sensor 86 is equal to or less than a threshold humidity (step S102). In step S102, judgment is carried out a plurality of times, similarly to step S20 shown in FIG. 9. Furthermore, the threshold humidity used in step S102 can employ the threshold humidity used in step S20 in FIG. 9, or can be set to a separate threshold humidity.

In step S102 in FIG. 10, if the humidity measured by the humidity sensor 86 is equal to or lower than the threshold humidity (Yes verdict), then the humidity measurement by the humidity sensor 86 and the comparison of the measured humidity and the threshold humidity (the humidity monitoring for the gas in the gas chamber 60) are continued. On the other hand, in step S102, if the humidity measured by the humidity sensor 86 exceeds the threshold humidity (No verdict), then an error is reported (step S104) and the humidity monitoring sequence is terminated (step S106).

Figure 11:
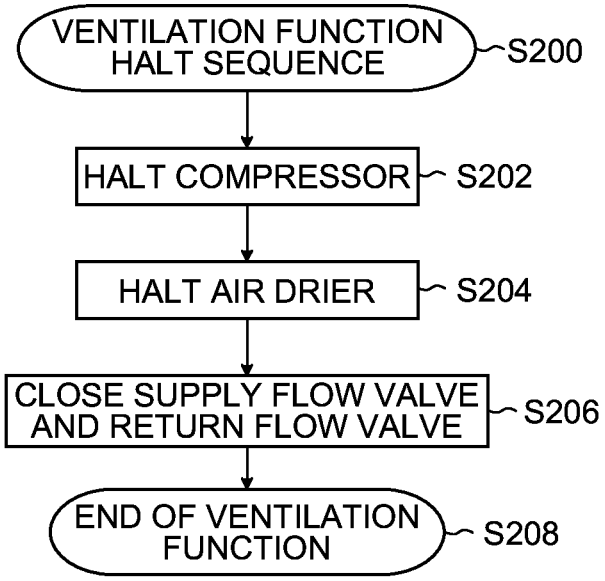
FIG. 11 is a flowchart showing a ventilation function halt sequence shown in FIG. 9.

FIG. 11 is a flowchart of the ventilation function halt sequence in step S28 shown in FIG. 9. When the ventilation function is halted, the following procedure is performed.

When the ventilation halt conditions are satisfied, the procedure transfers to the ventilation function halt sequence (step S200). Firstly, the compressor 72 in FIG. 7 is halted (step S202 in FIG. 11) and the air drier 76 in FIG. 7 is halted (step S204 in FIG. 11). Thereupon, the supply flow valve 80 and the return flow valve 84 in FIG. 7 are closed (step S206 in FIG. 11), and the halting of the ventilation function is completed (step S208).

According to the inkjet recording apparatus 10 which is composed as described above, the low humidity state is achieved by supplying the dry gas to the gas chamber 60 in which the piezoelectric elements 56 are accommodated, before operating the inkjet head 16, and the low humidity state of the gas chamber 60 is maintained during the supply of the electric power to the inkjet head 16 (at least during application of voltage to the piezoelectric elements 56). When the supply of dry gas to the gas chamber 60 is halted, the penetration of moisture into the gas chamber 60 that is in the low humidity state is prevented because the supply flow valve 80 and the return flow valve 84 are closed.

Moreover, since a voltage is applied to the piezoelectric elements 56 when a prescribed time has elapsed after starting the supply of dry gas to the gas chamber 60, then even in cases where the gas chamber 60 is in a state of high humidity before the supply of dry gas, the voltage is applied to the piezoelectric elements 56 after the gas chamber 60 has been changed to the low humidity state and breakage or deterioration of performance of the piezoelectric elements 56 is prevented.

Further, by arranging the gas outlet 40 connected to the external air of the return flow channel 82 to the exterior of the print unit 17, condensation on the ink ejection surface due to the gas discharged from the gas outlet 40 is prevented and the effects of the flow of the gas on the ejection of ink are also prevented.

Furthermore, since the relief valve 88 is connected to the dry gas supply flow channel 78, breakage of the gas chamber 60 and the dry gas supply flow channel 78, and the like, is prevented, even in cases where the gas return port 64 or the return flow channel 82 is blocked and the interior of the gas chamber 60 has reached a state of high pressure.

Furthermore, by arranging the moisture absorbing member 90 inside the gas chamber 60, the moisture which has penetrated inside the gas chamber 60 during the halt of the supply of dry gas is removed.

<Modification of Dry Gas Supply Unit>

Next, modifications of the dry gas supply unit 70 described above are explained.

<<First Modification>>

Figure 12:
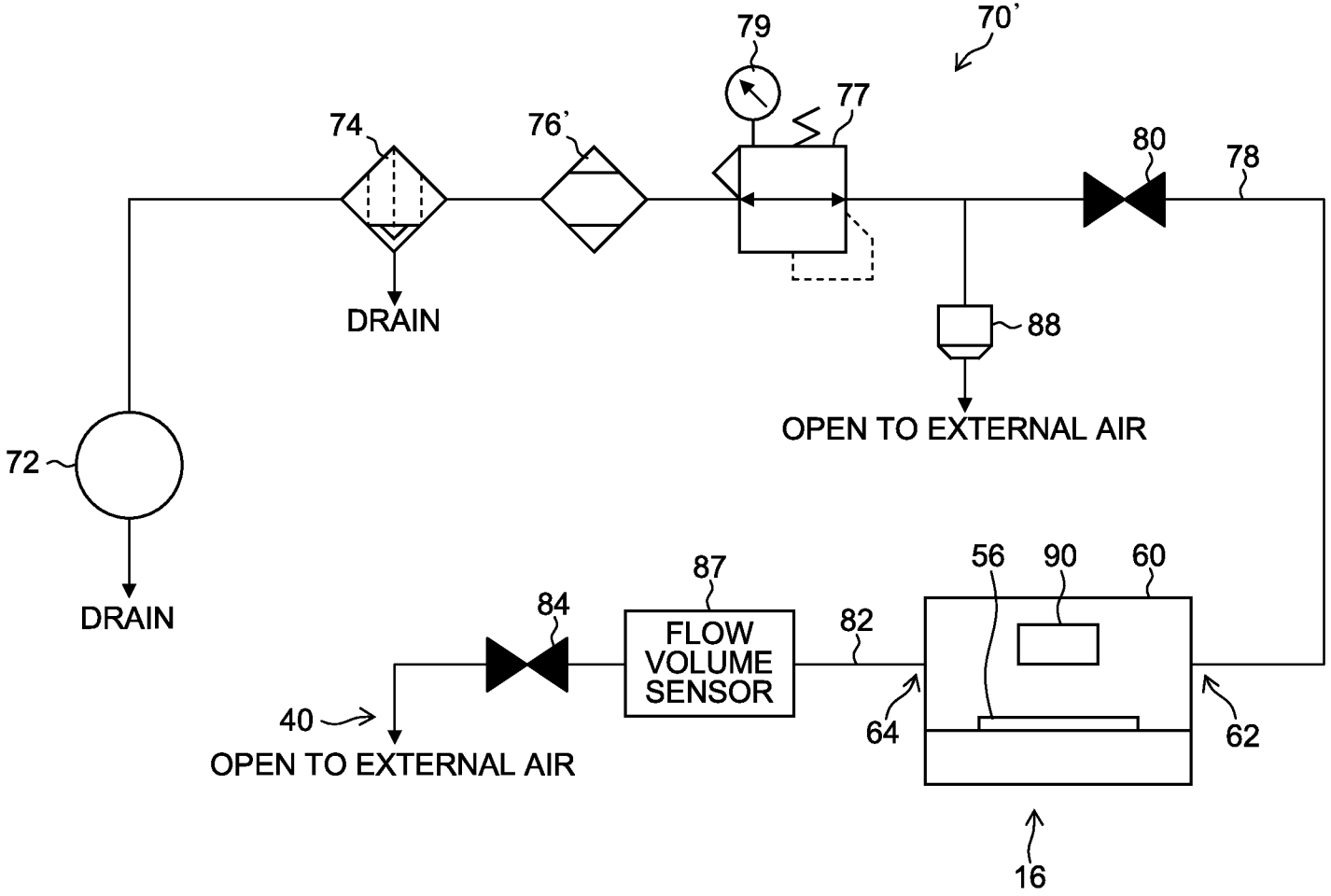
FIG. 12 is a block diagram showing the general composition of a dry gas supply unit according to a first modification of the embodiment of the present invention.

FIG. 12 is a block diagram showing a general composition of a dry gas supply unit 70' equipped with a filter type air drier 76'. The dry gas supply unit 70' shown in FIG. 12 includes a regulator 77 between the filter type air drier 76' and the supply flow valve 80, and the regulator 77 has a pressure gauge 79. The dry gas supply unit 70' shown in FIG. 12 includes a flow volume sensor 87 instead of the humidity sensor 86 shown in FIG. 7.

The filter type air drier 76' shown in FIG. 12 is provided with a plurality of hollow fibers made of special resin having properties for selectively passing moisture only, and is composed so as to remove moisture in the air by allowing the moisture only to pass to the exterior of the hollow fibers when the compressed air passes through the hollow fibers.

In the mode including the filter type air drier 76', which requires a higher pressure, the regulator 77 having the pressure gauge 79 is necessary on the downstream side of the filter type air drier 76' in terms of the gas flow direction. Furthermore, in this mode, it is possible to maintain a low humidity state in the gas chamber 60 provided that the dry gas is flowing, and therefore the flow volume sensor 87 is arranged instead of the humidity sensor 86 shown in FIG. 7.

Figure 13:
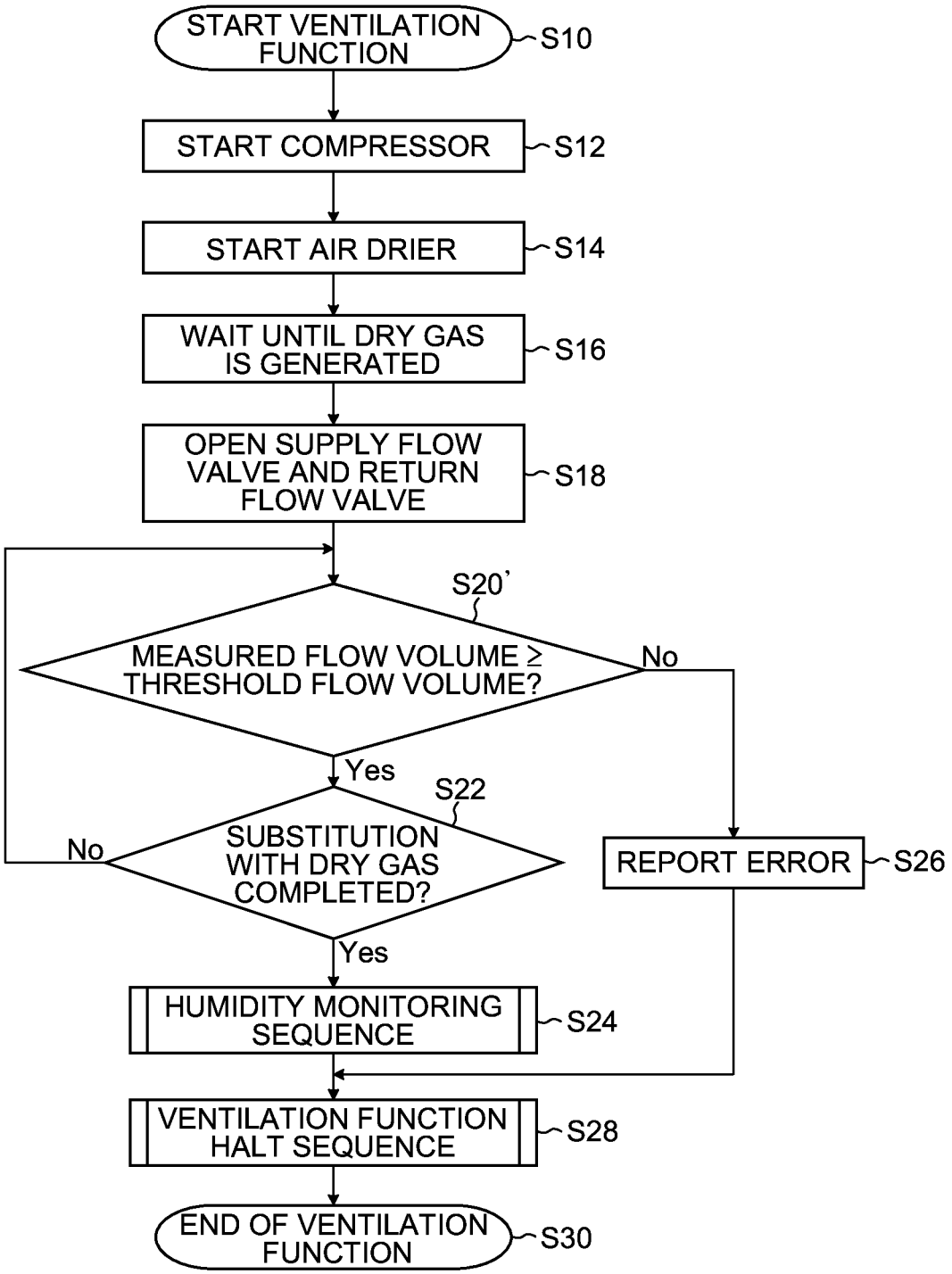
FIG. 13 is a flowchart showing a control sequence of a ventilation function in the first modification.

FIG. 13 is a flowchart of a ventilation function in the first modification. In the flowchart shown in FIG. 13, step S14 in FIG. 9 is omitted, and step S20 in FIG. 9 is replaced with step S20'. More specifically, since the filter type air drier 76' is not required to start up, then the air drier start-up step (step S14 in FIG. 9) is omitted, and since the flow volume sensor 87 is arranged instead of the humidity sensor 86, then in step S20' it is judged whether or not the flow volume of the gas returned from the gas chamber 60 as measured by the flow volume sensor 87 is equal to or greater than a threshold flow volume.

In step S20', if the flow volume measured by the flow volume sensor 87 is less than the threshold flow volume (No verdict), then it is judged that the gas chamber 60 has not reached a prescribed low humidity state, the procedure advances to step S26, and an error is reported. In step S20', a plurality of judgments are carried out similarly to step S20 shown in FIG. 9, and if the flow volume measured by the flow volume sensor 87 is less than the threshold flow volume continuously for a prescribed number of times, the procedure advances to step S26.

On the other hand, in step S20', if the flow volume measured by the flow volume sensor 87 is equal to or greater than the threshold flow volume (Yes verdict), then it is judged that the gas chamber 60 has reached the prescribed low humidity state, and the procedure advances to step S22.

Figure 14:
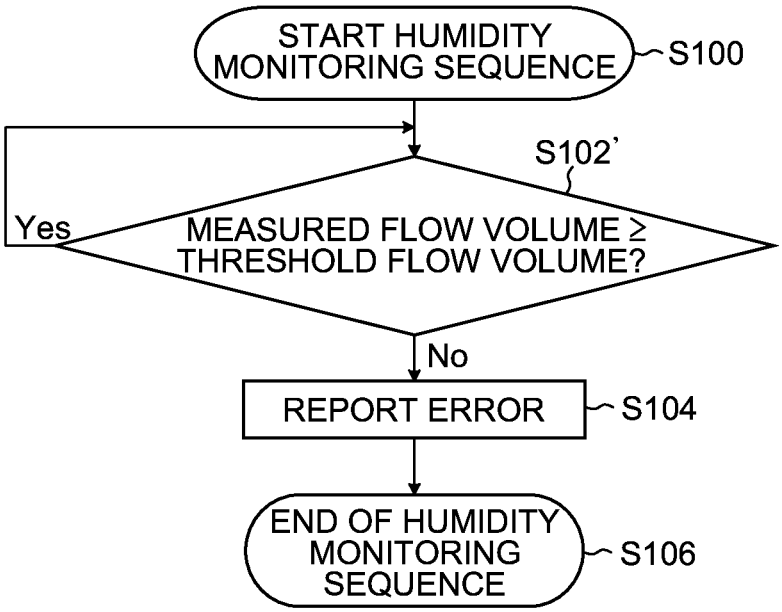
FIG. 14 is a flowchart showing a flow of a humidity monitoring sequence shown in FIG. 13.

FIG. 14 is a flowchart of the humidity monitoring sequence in the first modification. In the flowchart shown in FIG. 14, step S102 in FIG. 10 is replaced with step S102'. More specifically, instead of the measurement of the humidity of the gas returned from the gas chamber 60 in step S102 in FIG. 10, the measurement of the flow volume of the gas returned from the gas chamber 60 is carried out in step S102', and if the flow volume of the gas thus measured is less than a threshold flow volume (No verdict), it is judged that the gas chamber 60 has not reached the prescribed low humidity state, the procedure advances to step S104, and an error is reported. In step S102', a plurality of judgments are carried out similarly to step S20 shown in FIG. 9 and step S20' shown in FIG. 13, and if the flow volume measured by the flow volume sensor 87 is less than the threshold flow volume continuously for a prescribed number of times, the procedure advances to step S104.

On the other hand, if the measured flow volume of the gas is equal to or greater than the threshold flow volume at step S102' (Yes verdict), then it is judged that the gas chamber 60 is in the prescribed low humidity state and the measurement of the flow volume of the gas returned from the gas chamber 60 is carried out again (step S102').

According to the first modification of the dry gas supply unit, it is possible to omit the air drier start-up step by arranging the filter type air drier 76' instead of the cooling type air drier 76. Furthermore, by arranging the flow volume sensor 87 instead of the humidity sensor 86, it is possible to ascertain the humidity inside the gas chamber 60, on the basis of the flow volume of the gas returned from the gas chamber 60.

<<Second Modification>>

Figure 15:
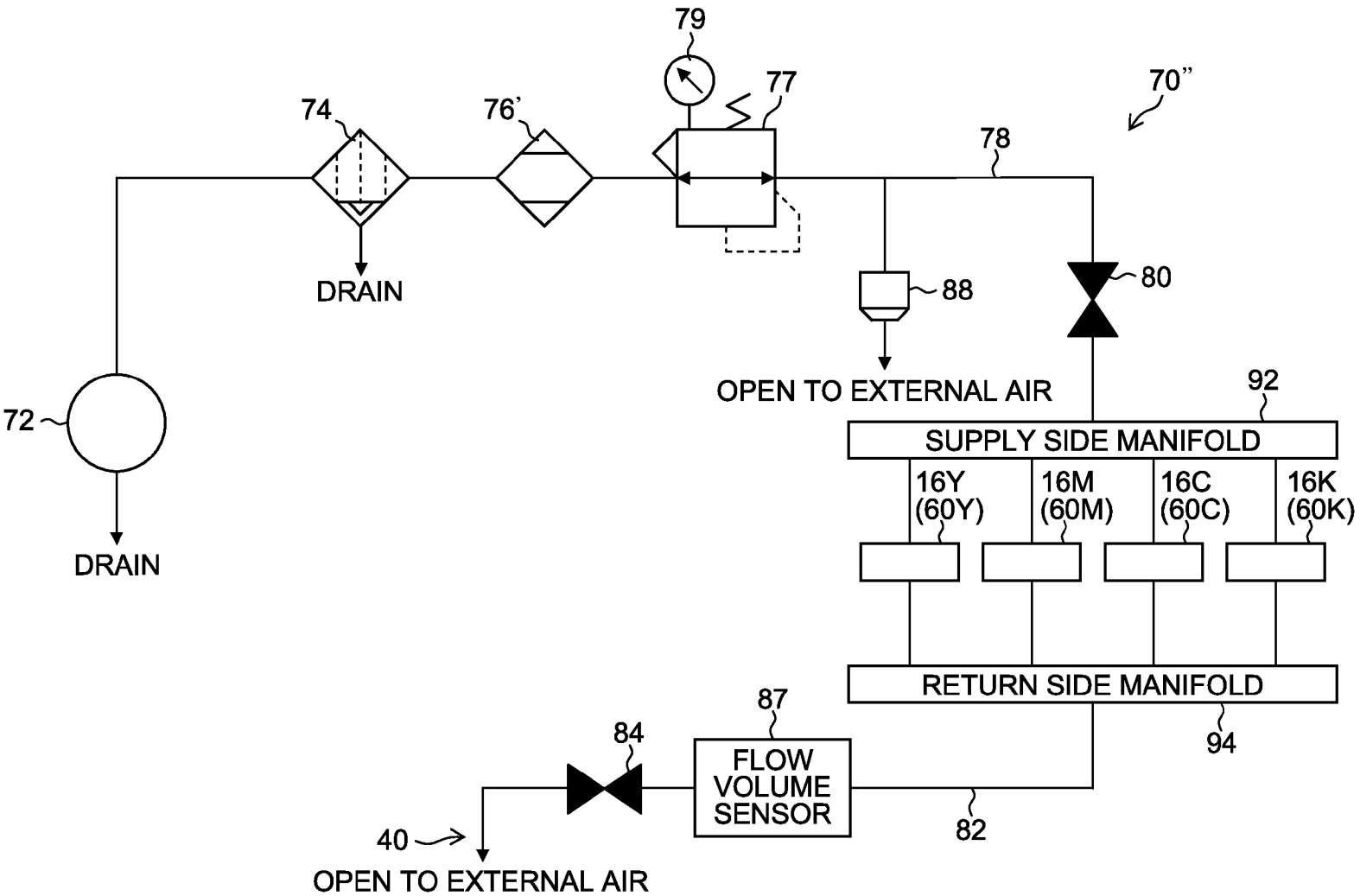
FIG. 15 is a block diagram showing the general composition of a dry gas supply unit according to a second modification of the embodiment of the present invention.

Next, a second modification of the dry gas supply unit is described. FIG. 15 is a block diagram showing a general composition of a dry gas supply unit 70" in a mode that includes gas chambers 60K, 60C, 60M and 60Y, in which the inkjet heads 16K, 16C, 16M and 16Y are arranged, respectively.

The dry gas supply unit 70" shown in FIG. 15 is a modification of the dry gas supply unit 70' shown in FIG. 12 and is further provided with a supply side manifold 92 and a return side manifold 94. The supply side manifold 92 functions as a dry gas distributary flow channel which connects the dry gas supply flow channel 78 to the gas chambers 60K, 60C, 60M and 60Y corresponding to the four inkjet heads 16K, 16C, 16M and 16Y. The return side manifold 94 functions as a gas tributary flow channel which connects the gas chambers 60K, 60C, 60M and 60Y to the return flow channel 82.

The supply side manifold 92 and the return side manifold 94 can also be replaced with joints.

The composition shown in FIG. 15 can also be applied to a mode where each head is constituted of the plurality of head modules joined together as shown in FIG. 4. More specifically, it is possible to adopt a mode which includes a supply side manifold (or joint) which connects the dry gas supply flow channel to the plurality of gas chambers corresponding to the plurality of head modules, and a return side manifold (or joint) which connects the plurality of gas chambers to the return flow channel.

According to the second modification of the dry gas supply unit, in the mode which includes the plurality of inkjet heads, or in the mode which includes the inkjet head constituted of the plurality of head modules joined together, the dry gas can be distributed uniformly to the inkjet heads or the head modules, and the gas can be returned from the inkjet heads or the head modules.

In the mode shown in FIG. 15, the supply flow valve 80 is arranged on the upstream side of the supply side manifold 92 in terms of the gas flow direction and the return flow valve 84 is arranged on the downstream side of the return side manifold 94 in terms of the gas flow direction, but it is also possible to adopt a mode where a plurality of supply flow valves are arranged respectively between the supply side manifold 92 and the inkjet heads 16K, 16C, 16M and 16Y, and also a mode where a plurality of return flow valves are arranged respectively between the inkjet heads 16K, 16C, 16M and 16Y and the return side manifold 94.

It is also possible to adopt a mode which includes the cooling air drier 76 (see FIG. 7), instead of the filter type air drier 76' of the dry gas supply unit 70" shown in FIG. 15. Moreover, the control flowchart can suitably employ the flowcharts shown in FIGS. 9, 10, 11, 13 and 14. Furthermore, a mode is also possible in which the moisture absorbing member 90 shown in FIG. 7 is arranged in each of the supply side manifold 92 and the return side manifold 94.

<Modification of Inkjet Recording Apparatus>

Figure 16:
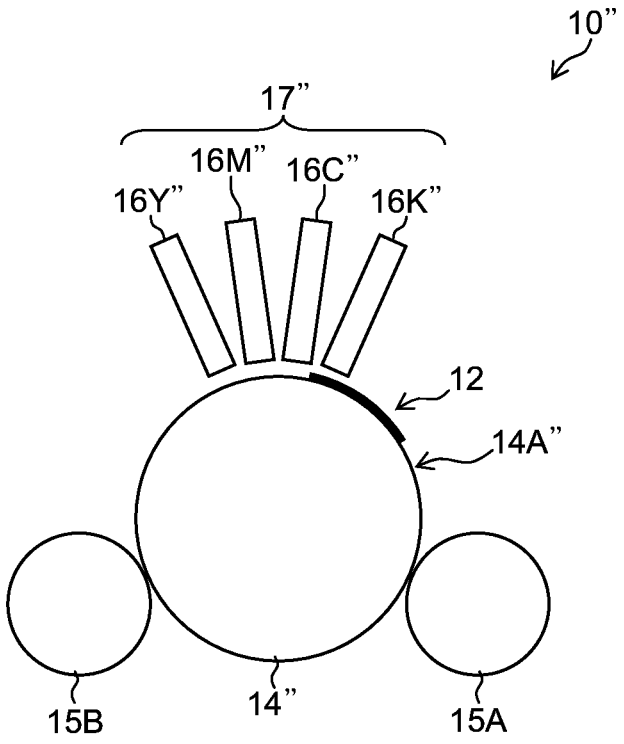
FIG. 16 is a schematic drawing showing the general composition of an inkjet recording apparatus according to another embodiment of the present invention.

Next, a modification of the inkjet recording apparatus is described. FIG. 16 is a schematic drawing showing a general composition of an inkjet recording apparatus 10" according to a modification embodiment. The inkjet recording apparatus 10" shown in FIG. 16 employs a pressure drum conveyance method, in which the recording medium 12 is held on an outer circumferential surface 14A" of a pressure drum 14", and the recording medium 12 is conveyed to rotate following the outer circumferential surface 14A" of the pressure drum 14" by rotating the pressure drum 14".

The inkjet heads 16K", 16C", 16M" and 16Y" are arranged obliquely to the horizontal plane, following the outer circumferential surface of the pressure drum 14". The inkjet heads 16K", 16C", 16M" and 16Y" can employ the composition of the inkjet heads 16K, 16C, 16M and 16Y shown in FIG. 1.

The recording medium 12 which is paid out from a paper supply unit (not shown) is held on the transfer drum 15A and transferred to the pressure drum 14". The recording medium 12 on which image formation has been carried out is transferred from the pressure drum 14" to a transfer drum 15B of a later stage.

It is possible to add processes prior to the image formation (a pre-processing step for the recording medium, and the like) and after the image formation (a drying step, a fixing step, and the like) to the inkjet recording apparatus 10" shown in FIG. 16.

In the embodiments of the present invention, the inkjet recording apparatuses which form color images on recording media and the drive methods for the inkjet heads arranged in the inkjet recording apparatuses have been described by way of example, but the scope of application of the present invention is not limited to the inkjet recording apparatuses.

For example, the present invention can also be applied broadly to any of liquid ejection apparatuses which eject liquid to media by an inkjet method, such as pattern forming apparatuses which form prescribed patterns (mask patterns, wiring patterns, etc.) by means of functional liquids containing resin particles and metal particles.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an inkjet head including: a nozzle which is configured to eject liquid; a pressure chamber which is connected to the nozzle and is configured to contain the liquid to be ejected from the nozzle; a piezoelectric element which is arranged on a wall of the pressure chamber on an outer side of the pressure chamber and is configured to apply pressure to the liquid contained in the pressure chamber; and a gas chamber which surrounds the piezoelectric element and a space peripheral to the piezoelectric element;

a dry gas supply device which is configured to generate dry gas having a dew point of not higher than a dew point of an atmosphere around the inkjet head, the dry gas supply device being configured to start supply of the dry gas to the gas chamber before supply of electric power to the inkjet head is started, to continue the supply of the dry gas to the gas chamber while the supply of the electric power to the inkjet head is continued, and to halt the supply of the dry gas to the gas chamber after the supply of the electric power to the inkjet head is halted;

a dry gas supply flow channel which has a first end and a second end, the first end of the dry gas supply flow channel being connected to the dry gas supply device, the second end of the dry gas supply flow channel being connected to the gas chamber;

a dry gas supply flow channel opening and closing device which is arranged in the dry gas supply flow channel and is configured to switch between connection and disconnection of the dry gas supply device and the gas chamber;

a gas return flow channel which has a first end and a second end, the first end of the gas return flow channel being connected to the gas chamber, the second end of the gas return flow channel being open to external air;

a gas return flow channel opening and closing device which is arranged in the gas return flow channel and is configured to switch between connection and disconnection of the gas chamber and the external air; and an opening and closing control device which is configured to control the dry gas supply flow channel opening and closing device and the gas return flow channel opening and closing device, wherein while the dry gas supply device halts the supply of the dry gas to the gas chamber, the opening and closing control device controls the dry gas supply flow channel opening and closing device to close to disconnect the dry gas supply device and the gas chamber, and controls the gas return flow channel opening and closing device to close to disconnect the gas chamber and the external air.

2. The liquid ejection apparatus as defined in claim 1, wherein when a prescribed period of time has elapsed after the dry gas supply device starts generation of the dry gas, the opening and closing control device controls the dry gas supply flow channel opening and closing device to open to connect the dry gas supply device and the gas chamber to start the supply of the dry gas to the gas chamber.

3. The liquid ejection apparatus as defined in claim 1, further comprising:

a drive voltage application device which is configured to apply a drive voltage to the piezoelectric element, wherein when a prescribed period of time has elapsed after the dry gas supply device starts the supply of the dry gas to the gas chamber, the drive voltage application device starts application of the drive voltage to the piezoelectric element.

4. The liquid ejection apparatus as defined in claim 3, further comprising:

a humidity measurement device which is configured to measure a humidity in the gas chamber, wherein when the humidity in the gas chamber measured by the humidity measurement device has become not higher than a threshold humidity, the drive voltage application device starts the application of the drive voltage to the piezoelectric element.

5. The liquid ejection apparatus as defined in claim 4, wherein the humidity measurement device includes a humidity sensor which is arranged on a downstream side of the dry gas supply device in a flow direction of the dry gas.

6. The liquid ejection apparatus as defined in claim 1, further comprising a moisture absorbing member which is arranged in at least one of the gas chamber, the dry gas supply flow channel and the gas return flow channel.

7. The liquid ejection apparatus as defined in claim 1, further comprising a relief valve which is arranged in the dry gas supply flow channel.

8. The liquid ejection apparatus as defined in claim 1, comprising:

a plurality of the inkjet heads; and a dry gas distributary flow channel which connects the dry gas supply flow channel to the respective inkjet heads.

9. The liquid ejection apparatus as defined in claim 8, further comprising a gas tributary flow channel which connects the respective inkjet heads to the gas return flow channel.

10. The liquid ejection apparatus as defined in claim 1, wherein:

the inkjet head includes a plurality of head modules; and the liquid ejection apparatus further comprises a dry gas distributary flow channel which connects the dry gas supply flow channel to the respective head modules.

11. The liquid ejection apparatus as defined in claim 10, further comprising a gas tributary flow channel which connects the respective head modules to the gas return flow channel.

12. The liquid ejection apparatus as defined in claim 11, further comprising a moisture absorbing member which is arranged in at least one of the dry gas distributary flow channel and the gas tributary flow channel.

13. The liquid ejection apparatus as defined in claim 1, wherein the dry gas supply device includes:

a compression device which is configured to compress gas;

a filter which is configured to remove foreign matter from the compressed gas; and an air drier which is configured to remove water content from the compressed gas that has passed through the filter.

14. The liquid ejection apparatus as defined in claim 1, wherein:

the dry gas supply device includes a filter type air drier; and the liquid ejection apparatus further comprises a regulator which is arranged between the filter type air drier and the inkjet head.

15. The liquid ejection apparatus as defined in claim 14, further comprising at least one of a flow volume sensor and a humidity sensor arranged on a downstream side of the filter type air drier in a flow direction of the dry gas.

16. The liquid ejection apparatus as defined in claim 1, wherein the dry gas supply flow channel has been degreased.

17. The liquid ejection apparatus as defined in claim 1, wherein the second end of the gas return flow channel has a gas outlet configured to discharge the dry gas flowing out from the gas chamber, the gas outlet being arranged to exterior of a print unit in which the inkjet head is arranged.

18. The liquid ejection apparatus as defined in claim 1, wherein the dew point of the dry gas is not higher than 15° C.

19. The liquid ejection apparatus as defined in claim 1, wherein at least one of the dry gas supply flow channel opening and closing device and the gas return flow channel opening and closing device is a normally closed type control valve which is closed while being not supplied with electric power.

20. The liquid ejection apparatus as defined in claim 1, wherein at least one of the dry gas supply flow channel opening and closing device and the gas return flow channel opening and closing device is a latch type control valve.

21. A drive method for an inkjet head which comprises: a nozzle which is configured to eject liquid; a pressure chamber which is connected to the nozzle and is configured to contain the liquid to be ejected from the nozzle; a piezoelectric element which is arranged on a wall of the pressure chamber on an outer side of the pressure chamber and is configured to apply pressure to the liquid contained in the pressure chamber; and a gas chamber which surrounds the piezoelectric element and a space peripheral to the piezoelectric element and is connected with a dry gas supply flow channel and a gas return flow channel, the dry gas supply flow channel having a first end connected to a dry gas supply device and a second end connected to the gas chamber, the gas return flow channel having a first end connected to the gas chamber and a second end open to external air, the method comprising:

before starting supply of electric power to the inkjet head, starting supply of dry gas to the gas chamber from the dry gas supply device through the dry gas supply flow channel, the dry gas having a dew point of not higher than a dew point of an atmosphere around the inkjet head;

continuing the supply of the dry gas to the gas chamber while the supply of the electric power to the inkjet head is continued;

halting the supply of the dry gas to the gas chamber after the supply of the electric power to the inkjet head is halted; and while the supply of the dry gas to the gas chamber is halted, disconnecting the dry gas supply device and the gas chamber by closing a dry gas supply flow channel opening and closing device arranged in the dry gas supply flow channel, and disconnecting the gas chamber and the external air by closing a gas return flow channel opening and closing device arranged in the gas return flow channel.

* * * * *